US010252518B2

(12) United States Patent
Nitta et al.

(10) Patent No.: US 10,252,518 B2
(45) Date of Patent: Apr. 9, 2019

(54) CORRECTION DATA GENERATING APPARATUS, INKJET HEAD, AND INKJET PRINTER

(71) Applicant: TOSHIBA TEC KABUSHIKI KAISHA, Shinagawa-ku, Tokyo (JP)

(72) Inventors: Noboru Nitta, Tagata Shizuoka (JP); Teruyuki Hiyoshi, Izunokuni Shizuoka (JP); Shunichi Ono, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/452,796

(22) Filed: Mar. 8, 2017

(65) Prior Publication Data

US 2017/0305148 A1 Oct. 26, 2017

(30) Foreign Application Priority Data

Apr. 22, 2016 (JP) ..... 2016-086534

(51) Int. Cl.
*B41J 2/045* (2006.01)

(52) U.S. Cl.
CPC ..... *B41J 2/04508* (2013.01); *B41J 2/04506* (2013.01); *B41J 2/04581* (2013.01); (Continued)

(58) Field of Classification Search
CPC ..... B41J 2/04508; B41J 2/04586
See application file for complete search history.

(56) References Cited

U.S. PATENT DOCUMENTS 6,283,570 B1 9/2001 Komiya et al.
9,302,475 B2 4/2016 Nitta et al.
(Continued)

FOREIGN PATENT DOCUMENTS

EP 1475233 11/2004
JP 2008055781 3/2008
(Continued)

OTHER PUBLICATIONS

European Search Report for European Patent Application No. 17162806.8 completed on Aug. 24, 2017.

*Primary Examiner* — Thinh H Nguyen
(74) *Attorney, Agent, or Firm* — Amin, Turocy & Watson LLP

(57) ABSTRACT

A correction data setting apparatus, which sets correction data in a memory for storing the correction data for correcting a pulse width of a drive pulse signal applied to each actuator corresponding to each nozzle of an inkjet head, comprises a generation section which sequentially generates a channel No. for individually identifying each nozzle; an output section which outputs a parameter required for arithmetic which represents a characteristic of a correction amount with respect to an arrangement direction of the nozzles; an arithmetic section which executes the arithmetic using the parameter output from the output section to calculate the correction amount for each channel No. generated from the generation section; a conversion section converts the correction amount calculated for each channel No. by the arithmetic section to the correction data; and a setting section sets the correction data obtained for each channel No. by the conversion section in the memory.

8 Claims, 23 Drawing Sheets

(52) U.S. Cl.
CPC ..... *B41J 2/04586* (2013.01); *B41J 2/04588* (2013.01); *B41J 2/04595* (2013.01)

(56) References Cited

U.S. PATENT DOCUMENTS

| | | | | |
|---|---|---|---|---|
| 2007/0013791 | A1 | 1/2007 | Kinoshita et al. | |
| 2012/0223989 | A1 | 9/2012 | Takagi et al. | |
| 2013/0038657 | A1* | 2/2013 | Viturro | B41J 29/393 347/19 |
| 2016/0039199 | A1* | 2/2016 | Hiyoshi | B41J 2/04536 347/10 |
| 2016/0121606 | A1 | 5/2016 | Kimura et al. | |
| 2016/0167378 | A1 | 6/2016 | Kimura et al. | |

FOREIGN PATENT DOCUMENTS

| | | |
|---|---|---|
| JP | 2012-45780 | 3/2012 |
| JP | 2013-59961 | 4/2013 |
| JP | 2016-55513 | 4/2016 |

* cited by examiner

FIG.11

315

TA1

| PARAMETER | a1 |
|---|---|
| CHANNEL No. | CORRECTION TIME t |
| 1 | t01 |
| 2 | t02 |
| 3 | t03 |
| 4 | t04 |
| ⋮ | ⋮ |
| n | t0n |

TA2

| PARAMETER | a2 |
|---|---|
| CHANNEL No. | CORRECTION TIME t |
| 1 | t01 |
| 2 | t02 |
| 3 | t03 |
| 4 | t04 |
| ⋮ | ⋮ |
| n | t0n |

---

CORRECTION DATA GENERATING APPARATUS, INKJET HEAD, AND INKJET PRINTER

CROSS-REFERENCE TO RELATED APPLICATIONS

This application is based upon and claims the benefit of priority from Japanese Patent Application No. P2016-086534, filed Apr. 22 2016, the entire contents of which are incorporated herein by reference.

FIELD

Embodiments described herein relate generally to a generating apparatus of correction data relating to density correction of an inkjet printer which carries out printing with the correction data set by the generating apparatus.

BACKGROUND

For an inkjet head formed by arranging a plurality of nozzles for ejecting ink drops in one direction, volumes of the ink drops ejected from respective nozzles are not always uniform. Thus, there are times when density unevenness is generated even in a case in which the same number of ink drops is ejected from each nozzle to print a solid image. Furthermore, there are times when a difference in level of density is generated at a border between an inkjet head and an inkjet head in a case in which a print area with a wide width is divided in a width direction and printing is carried out by a plurality of the inkjet heads which is arranged by matching an arrangement direction of the nozzles with the width direction.

The reason why the volumes of the ink drops ejected from the respective nozzles are not uniform is primarily attributable to unevenness in structure is generated in the inkjet head. For example, diameters of respective nozzles or volumes of pressure chambers separately communicating with the respective nozzles are not always uniform. In most cases, this unevenness in structure is caused by characteristics of a processing machine used at the time of manufacturing the inkjet head.

Conventionally, there is a technology for adjusting an ejection amount of ink drops for each nozzle by correcting a pulse width of a drive pulse signal applied to each of the actuators respectively corresponding to each of nozzles. The amount of the ink drops ejected from each nozzle can be homogenized using this technology. Correction data for correcting the pulse width for each nozzle has to be derived in order to homogenizing the amount. For example, 300 separate correction data must be derived for the inkjet head having 300 nozzles, which requires a cumbersome amount of time. JP2008-57781A discloses an image forming apparatus using a recording head in which discharge nozzles are two-dimensionally arranged with certain regularity is configured to form a reference image on the recording medium with a resolution corresponding to pitches of nozzles in the direction perpendicular to the direction according to which the relative movement of the medium and head is performed. Then, the reference image is scanned with a CCD line sensor, at a resolution lower than said resolution, and is used as reference image data. Then, an ink density distribution of nozzles is obtained based on the reference image data and the tendency of regularity of the ink density distribution. Then an ink density correction table for correcting the discharge amount of ink droplets by the discharge nozzles based on the ink density distribution whereby the discharge amount of the ink can be controlled. However, this method of correction is too complex.

DESCRIPTION OF THE DRAWINGS

FIG. 11 is a schematic diagram illustrating an example of a correction data table stored in a storage section in FIG. 10;

DETAILED DESCRIPTION

In accordance with an embodiment, a correction data generating apparatus, which generates and outputs correction data for correcting a pulse width of a drive pulse signal applied to each of actuators respectively corresponding to each of nozzles of an inkjet head, comprises a generation section, a parameter output section, an arithmetic section, a conversion section and a correction data output section. The generation section sequentially generates a channel No. for individually identifying each nozzle. The parameter output section outputs a parameter required for arithmetic which represents a characteristic of a correction amount with respect to an arrangement direction of the nozzles. The arithmetic section carries out the arithmetic using the parameter output from the parameter output section to calculate the correction amount for each channel No. generated from the generation section. The conversion section converts the correction amount calculated for each channel No. by the arithmetic section to the correction data. The correction data output section outputs the correction data obtained for each channel No. by the conversion section.

Hereinafter, an embodiment of a correction data generating apparatus for an inkjet head and an inkjet printer for carrying out printing with correction data set by the correction data generating apparatus is described with reference to the accompanying drawings. In the embodiment, an inkjet printer with a share mode-type inkjet head 100 (refer to FIG. 1) is exemplified.

Figure 1:
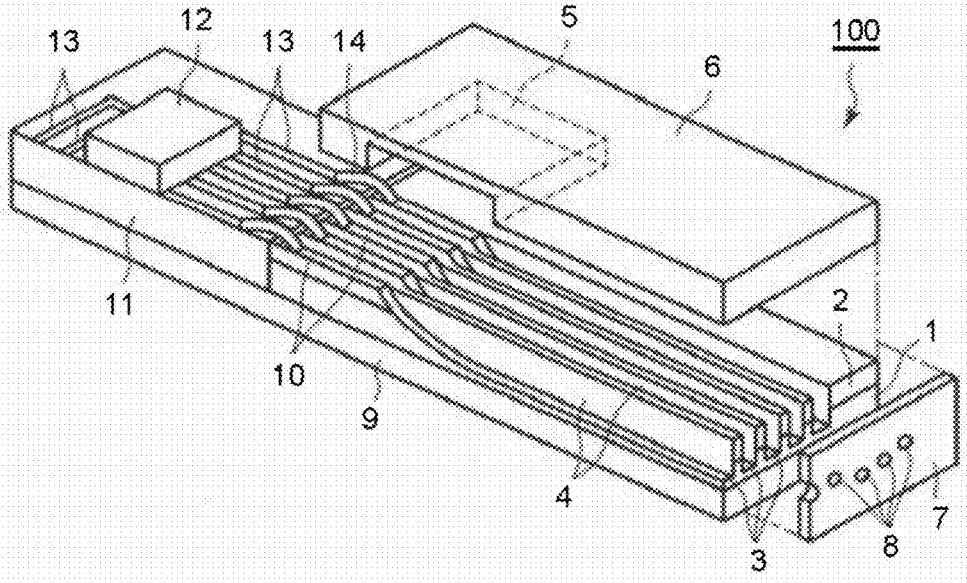
FIG. 1 is an exploded perspective view illustrating part of an inkjet head according to an embodiment.
Figure 2:
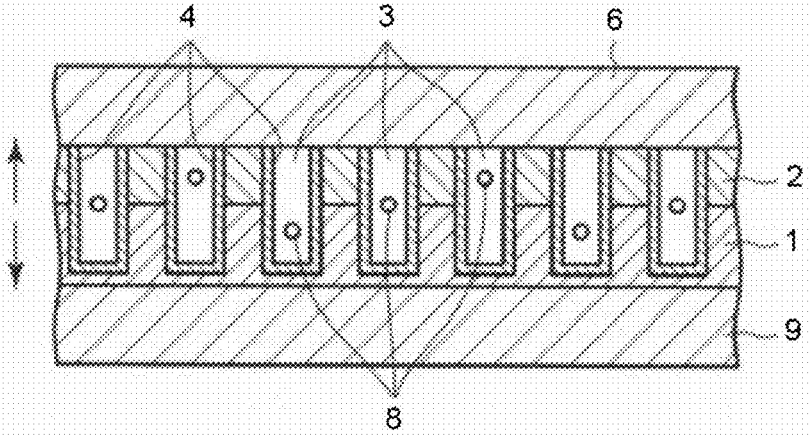
FIG. 2 is a cross-section view of a front part of the inkjet head.
Figure 3:
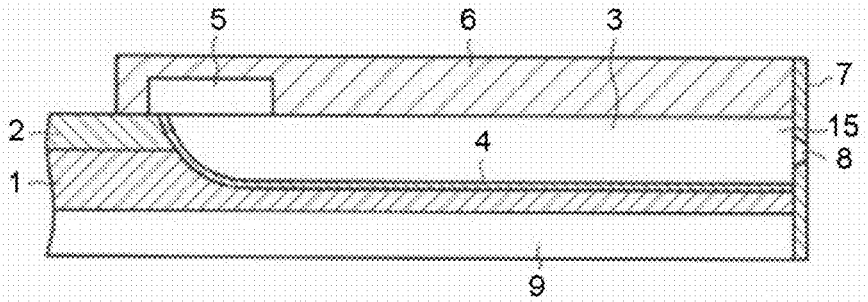
FIG. 3 is a longitudinal section view of the front part of the inkjet head.

Firstly, the constitution of the inkjet head 100 (hereinafter, simply referred to as a head 100) is described with reference to FIG. 1 to FIG. 3. FIG. 1 is an exploded perspective view illustrating part of the head 100, FIG. 2 is a cross-section view of a front part of the head 100, and FIG. 3 is a longitudinal section view of the front part of the head 100. For the head 100, a longitudinal direction is set as a vertical direction and a direction orthogonal to the longitudinal direction is set as a lateral direction.

The head 100 includes a rectangular base substrate 9. The head 100 bonds a first piezoelectric member 1 to the upper surface at the upper side of the base substrate 9, and bonds a second piezoelectric member 2 on the upper surface of the first piezoelectric member 1. The bonded first piezoelectric member 1 and second piezoelectric member 2 are polarized in directions opposite to each other along the thickness direction of the base substrate 9 as shown by arrows in FIG. 2.

The base substrate 9 is made from a material which has a small dielectric constant and of which the difference in thermal expansion coefficient from the piezoelectric members 1 and 2 is small. As a material of the base substrate 9, for example, alumina ($Al_2O_3$), silicon nitride ($Si_3N_4$), silicon carbide (SiC), aluminum nitride (AlN) and lead zirconic titanate (PZT) are preferable. On the other hand, as a material of the piezoelectric members 1 and 2, lead zirconic titanate (PZT), lithium niobate ($LiNbO_3$) and lithium tantalate ($LiTaO_3$) are used.

The head 100 arranges a plurality of long grooves 3 from the front end side towards the rear end side of the bonded piezoelectric members 1 and 2. The grooves 3 are arranged with a given interval successively therebetween in parallel with each other. The front end of each groove 3 is opened and the rear end thereof is inclined upwards. A cutting machine can be used for the formation of such a large number of the grooves 3.

The head 100 arranges an electrode 4 on a partition wall of each groove 3. The electrode 4 has a two-layer structure consisting of thin gold (Au) over nickel (Ni). The electrode 4 is formed uniformly in each groove 3 with a plating method. The forming method of the electrode 4 is not limited to the plating method. In addition, a sputtering method or an evaporation method may also be used.

The head 100 arranges an extraction electrode 10 from the rear end of each groove 3 towards the upper surface of the rear side of the second piezoelectric member 2. The extraction electrode 10 extends from the electrode 4.

The head 100 includes a top plate 6 and an orifice plate 7. The top plate 6 seals the upper part of each groove 3. The orifice plate 7 seals the front end of each groove 3. In the head 100, a plurality of pressure chambers 15 is formed with the grooves 3 each of which is surrounded by the top plate 6 and the orifice plate 7. The pressure chambers 15 each of which has a shape with a depth of 300 μm and a width of 80 μm are arranged in parallel, for example, at a pitch of 169 μm. However, the shapes of the respective pressure chambers 15 are not always uniform due to dispersion at the time of the manufacture which is caused by characteristics of the cutting machine. For example, the cutting machine collectively forms 16 pressure chambers 15 and forms 320 pressure chambers 15 by repeating the operation of the formation of 16 pressure chambers 15 for 20 times. At this time, if processing blades that form the 16 pressure chambers have individual differences, the shape of each pressure chamber 15 has a periodicity. Furthermore, the shape of the pressure chamber is changed little by little due to change of a processing temperature at the time of the repeating processing of 20 times. The tiny change of these pressure chambers 15 becomes one of reasons of tiny periodic change of a print density eventually.

The top plate 6 comprises a common ink chamber 5 at the rear of the inside thereof. The orifice plate 7 arranges a nozzle 8 at a position opposite to each groove 3. The nozzles 8 are connected with the grooves 3, in other words, the pressure chambers 15 facing the nozzles 8. The nozzle 8 is formed into a taper shape from the pressure chamber 15 side towards the ink ejection side of the opposite side to the pressure chamber 15 side. Three nozzles 8 corresponding to the adjacent three pressure chambers 15 are assumed as a set and are formed in a shifted manner at a given interval in the height direction (vertical direction of paper surface of FIG. 2) of the groove 3. In FIG. 2, the nozzle 8 is schematically illustrated so that the position of the nozzle 8 is understood. The nozzle 8, for example, can be formed by a laser processing machine. At the time the laser processing machine forms a nozzle at a predetermined position, as a method for determining a processing position of each nozzle, there is a method for optically setting a position of a laser beam and a work, that is, a method for mechanically moving the orifice plate side. In a case in which there are a large number of nozzles, it is convenient to use the two methods together. However, if a hole processing using the optical position determining method and the mechanical position determining method together is carried out, a periodicity is generated in a hole shape due to the tiny change of the hole shape of each of respective processing. The periodicity of the hole shape becomes one of reasons of the tiny periodic change of the print density.

The head 100 bonds a printed substrate 11 on which conductive patterns 13 are formed to the upper surface at the rear side of the base substrate 9. The head 100 carries a driver IC 12 in which a head drive circuit 101 (refer to FIG. 8) described later is mounted on the printed substrate 11. The driver IC 12 is connected with the conduction patterns 13. The conduction patterns 13 are combined with each extraction electrode 10 via conducting wires 14 through a wire bonding. The number of the driver ICs 12 may be one and the driver IC 12 may drive electrodes corresponding to all the nozzles; however, if the number of circuits per drive IC is too large, several demerits are generated, for example, a chip size becomes large and a yield is reduced, wiring of a output circuit becomes difficult, heat generation at the time of drive is concentrated, and the increase and decrease of the number of ICs cannot correspond to the increase and decrease of the number of the nozzles. Thus, for example, four drive ICs with output 80 circuit are used for a head with 320 nozzles. However, in this case, an output waveform has a spatial periodicity according to a nozzle arrangement direction due to a difference of wiring resistance in the drive IC. The strength of the periodicity is changed depending on the individual difference of the drive IC 12. The spatial periodicity of the output waveform becomes one of reasons of the tiny periodic change of the print density.

A group consisting of a pressure chamber 15, an electrode 4 and a nozzle 8 included in the head 100 is referred to as a channel. In other words, the head 100 includes channels of which the number corresponds to that of the grooves 3. The share mode-type head 100 does not eject ink from channels at both ends. However, in the present embodiment, for convenience of description, the number of the channels from which the ink is ejected is set as n, channel numbers 1, 2, 3, . . . , n are aligned in order from one end side to the other end side along the arrangement direction of the nozzles 8. In other words, a channel at one end side when the head 100 is viewed from the front is referred to as ch.1, and a channel adjacent to ch.1 is referred to as ch.2. Hereinafter, in the same way, a channel at the other end side is referred to as ch.n by aligning a channel number.

Next, an operation principle of the head 100 constituted as stated above is described with reference to FIG. 4 and FIG. 5.

Figure 4:
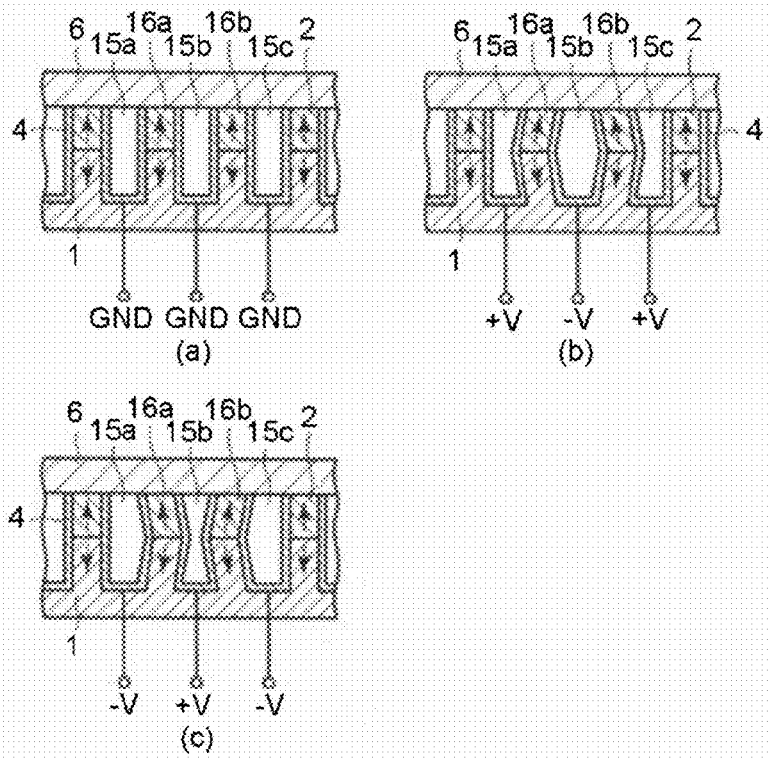
FIG. 4 is a schematic diagram illustrating an operation principle of the inkjet head.

(a) in FIG. 4 illustrates a state in which the potential of each electrode 4 which is arranged on each wall surface of a pressure chamber 15*b* at the center and pressure chambers 15*a* and 15*c* adjacent to both sides of the pressure chamber 15*b* is ground potential GND. In such a state, no distortion effect acts on both a partition wall 16*a* sandwiched by the pressure chamber 15*a* and the pressure chamber 15*b* and a partition wall 16*b* sandwiched by the pressure chamber 15*b* and the pressure chamber 15*c*.

(b) in FIG. 4 illustrates a state in which a voltage −V having the negative polarity is applied to the electrode 4 of the central pressure chamber 15*b* and a voltage +V having the positive polarity is applied to the electrodes 4 of the pressure chambers 15*a* and 15*c* adjacent to both sides of the pressure chamber 15*b*. In such a state, an electric field which is twice as large as that of the voltage V acts on the partition walls 16*a* and 16*b* in a direction orthogonal to the polarized direction of the piezoelectric members 1 and 2. Through such an action, each of the partition walls 16*a* and 16*b* is deformed towards outside such that the volume of the pressure chamber 15*b* is expanded.

(c) in FIG. 4 illustrates a state in which a voltage +V having the positive polarity is applied to the electrode 4 of the central pressure chamber 15*b* and a voltage −V having the negative polarity is applied to the electrodes 4 of the pressure chambers 15*a* and 15*c* adjacent to both sides of the pressure chamber 15*b*. In such a state, the electric field which is twice as large as that of the voltage V acts on the partition walls 16*a* and 16*b* in a direction reverse to that shown in FIG. 4(*b*). Through such an action, each of the partition walls 16*a* and 16*b* is deformed towards inside such that the volume of the pressure chamber 15*b* is contracted.

Figure 5:
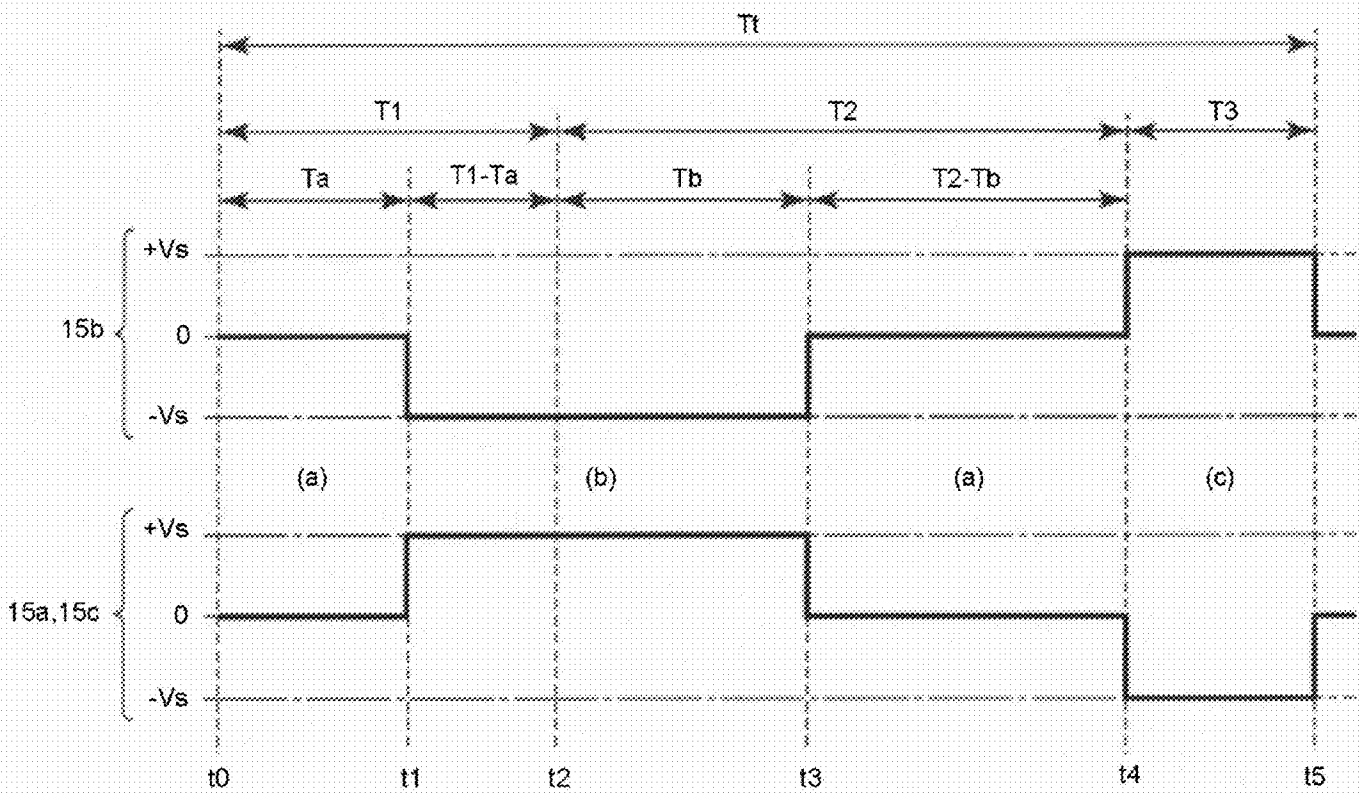
FIG. 5 is waveform diagram illustrating a standard pulse waveform of a drive pulse signal applied to the inkjet head.

FIG. 5 illustrates a standard pulse waveform of a drive pulse signal applied to each electrode 4 of the pressure chamber 15*b* and the pressure chambers 15*a* and 15*c* adjacent to both sides of the pressure chamber 15*b* in order to eject an ink drop from the pressure chamber 15*b*. A section indicated by time Tt refers to time required for ejection of an ink drop, and the time Tt is divided into time of a preparation section, so-called preparation time T1, time of an ejection section, so-called ejection time T2, and time of a post processing section, so-called post processing time T3. Furthermore, the preparation time T1 is subdivided into time of a stationary section, so-called stationary time Ta, and time of an expansion section, so-called expansion time (T1−Ta), and the ejection time T2 is subdivided into time of a maintenance section, so-called maintenance time Tb, and time of a restoration section, so-called restoration time (T2−Tb). In general, the preparation time T1 consisting of the stationary time Ta and the expansion time (T1−Ta), the ejection time T2 consisting of the maintenance time Tb and the restoration time (T2−Tb) and the post processing time T3 are set to proper values according to conditions such as ink to be used and a temperature.

As shown in FIG. 5, the head 100 firstly applies a voltage of 0 volt to the electrode 4 corresponding to the pressure chamber 15*b* at point in time t0. At this time, the head 100 also applies the voltage of 0 volt to each of the electrodes 4 respectively corresponding to the pressure chambers 15*a* and 15*c*. Then, the head 100 waits for the elapse of the stationary time Ta. During this time, each of the pressure chambers 15*a*, 15*b* and 15*c* maintains the state of (a) in FIG. 4.

At point in time t1 after the stationary time Ta elapses, the head 100 applies the voltage (−Vs) having the negative polarity to the electrode 4 corresponding to the pressure chamber 15*b*. At this time, the head 100 applies the voltage (+Vs) having the positive polarity to each of the electrodes 4 respectively corresponding to the pressure chambers 15*a* and 15*c*. Then, the head 100 waits for the elapse of the expansion time (T1−Ta).

If the voltage (−Vs) having the negative polarity is applied to the electrode 4 corresponding to the pressure chamber 15*b* and the voltage (+Vs) having the positive polarity is applied to each of the electrodes 4 respectively corresponding to the pressure chambers 15*a* and 15*c*, each of the partition walls 16*a* and 16*b* at both sides of the pressure chamber 15*b* is deformed towards outside such that the volume of the pressure chamber 15*b* is expanded, and becomes the state of (b) in FIG. 4. The pressure in the pressure chamber 15*b* is reduced due to the deformation. Thus, the ink flows into the pressure chamber 15*b* from the common ink chamber 5.

At point in time t2 after the expansion time (T1−Ta) elapses, the head 100 further continues to apply the voltage (−Vs) having the negative polarity to the electrode 4 corresponding to the pressure chamber 15*b* until the maintenance time Tb elapses. Furthermore, the head 100 continues to apply the voltage (+Vs) having the positive polarity to the electrodes 4 respectively corresponding to the pressure chambers 15*a* and 15*c*. During this time, each of the pressure chambers 15*a*, 15*b* and 15*c* maintains the state of (b) in FIG. 4.

At point in time t3 after the maintenance time Tb elapses, the head 100 returns the voltage applied to the electrode 4 corresponding to the pressure chamber 15*b* to 0 volt. At this time, the head 100 also returns the voltage applied to each of the electrodes 4 respectively corresponding to the pressure chambers 15*a* and 15*c* to 0 volt. Then, the head 100 waits for the elapse of the restoration time (T2−Tb).

If the voltages applied to the electrodes 4 respectively corresponding to the pressure chambers 15*a*, 15*b* and 15*c* become 0 volt, each of the partition walls 16*a* and 16*b* at both sides of the pressure chamber 15*b* is restored to the stationary state, and returns to the state of (a) in FIG. 4. The pressure in the pressure chamber 15*b* is increased due to the restoration, and an ink drop is ejected from the nozzle 8 corresponding to the pressure chamber 15*b*.

At point in time t4 after the restoration time (T2−Tb) elapses, the head 100 applies the voltage (+Vs) having the positive polarity to the electrode 4 corresponding to the pressure chamber 15*b*. At this time, the head 100 applies the voltage (−Vs) having the negative polarity to each of the electrodes 4 respectively corresponding to the pressure chambers 15*a* and 15*c*. Then, the head 100 waits for the elapse of the post processing time T3.

If the voltage (+Vs) having the positive polarity is applied to the electrode 4 corresponding to the pressure chamber 15*b* and the voltage (−Vs) having the negative polarity is applied to each of the electrodes 4 respectively corresponding to the pressure chambers 15*a* and 15*c*, each of the partition walls 16*a* and 16*b* at both sides of the pressure chamber 15*b* is deformed towards inside such that the volume of the pressure chamber 15*b* is contracted, and becomes the state of (c) in FIG. 4. The pressure in the pressure chamber 15*b* is further increased due to the deformation. Thus, a pressure vibration occurring in the pressure chamber 15*b* after the ejection of the ink drop is alleviated.

At point in time t5 after the post processing time T3 elapses, the head 100 returns the voltage applied to the electrode 4 corresponding to the pressure chamber 15*b* to 0 volt. At this time, the head 100 also returns the voltage applied to each of the electrodes 4 respectively corresponding to the pressure chambers 15*a* and 15*c* to 0 volt. If the voltages applied to the electrodes 4 respectively corresponding to the pressure chambers 15*a*, 15*b* and 15*c* become 0 volt, each of the partition walls 16*a* and 16*b* at both sides of the pressure chamber 15*b* is restored to the stationary state, and returns to the state of (a) in FIG. 4. At this time, pressure vibration left in the pressure chamber 15*b* is cancelled.

The head 100 supplies the drive pulse signal with such the standard pulse waveform to each of the electrodes 4 of the pressure chamber 15*b* serving as an ink ejection object and the pressure chambers 15*a* and 15*c* adjacent to the pressure chamber 15*b*. Then, each of the partition walls 16*a* and 16*b* composed of the piezoelectric members 1 and 2 is driven such that the volume of the pressure chamber 15*b* is expanded or contracted, and the ink drop is ejected from the nozzle 8 corresponding to the pressure chamber 15*b*. Herein, the partition walls 16*a* and 16*b* composed of the piezoelectric members 1 and 2 and the electrodes 4 arranged on the partition walls 16*a* and 16*b* constitute an actuator for drive in order to eject the ink drop from the nozzle 8 communicating with the pressure chamber 15*b* partitioned by the partition walls 16*a* and 16*b*.

Next, a case of carrying out gradation printing by a multi-drop method with the head 100 is described. The multi-drop method is a printing method for varying the number of the ink drops being shot for one dot to change density of one dot without changing the size of the ink drop and expressing gradation. In order to realize such the printing method, the drive pulse voltage may be applied to the actuator corresponding to the nozzle 8 serving as the ink ejection object continuously and repeatedly more than once. For example, two ink drops are ejected from the nozzle 8 corresponding to the actuator by continuously applying the drive pulse voltage to the actuator twice. Similarly, seven ink drops are ejected from the nozzle 8 corresponding to the actuator by continuously applying the drive pulse voltage to the actuator for seven times. In this way, the head 100 carries out the gradation printing by the multi-drop method.

Figure 6:
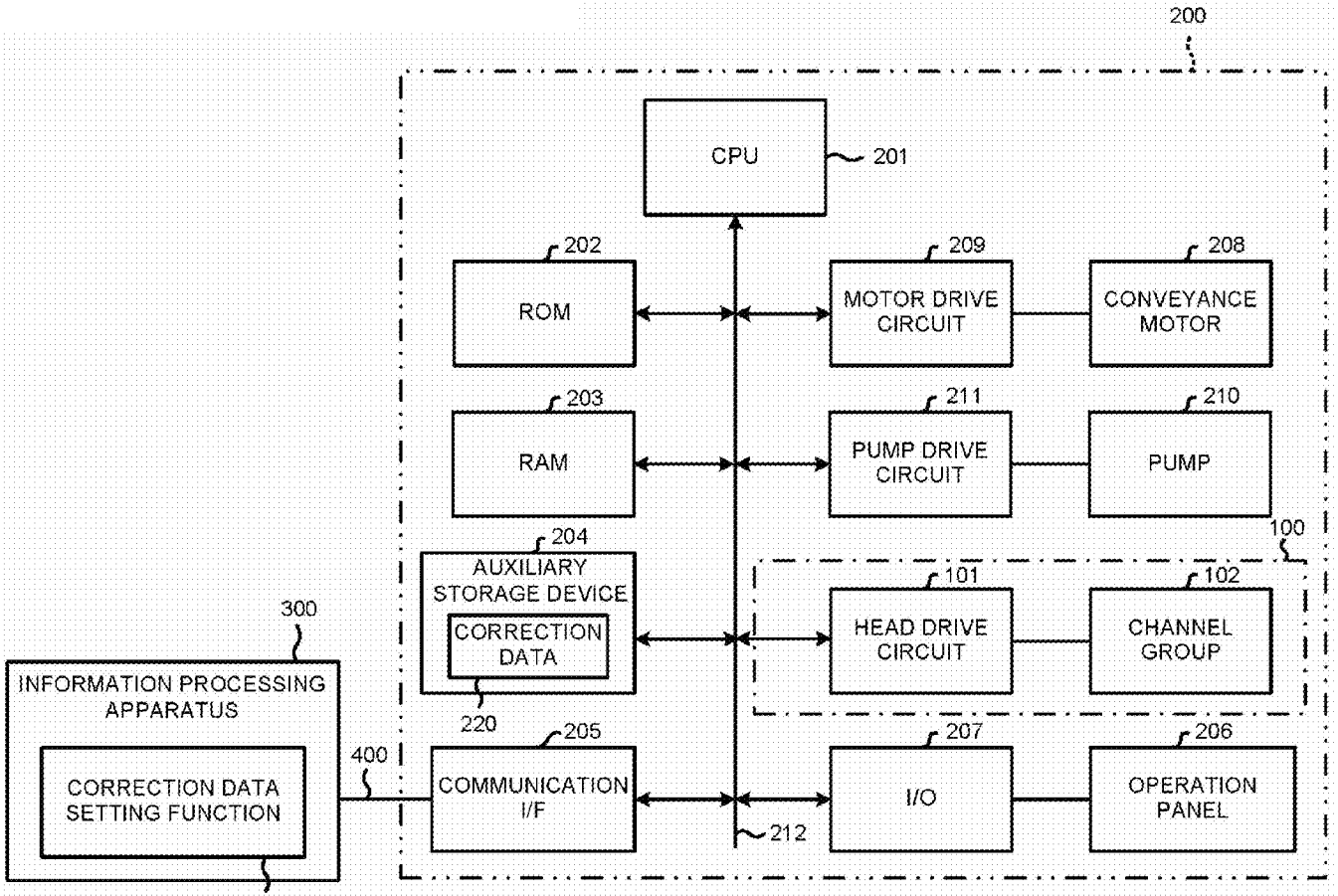
FIG. 6 is a block diagram illustrating a hardware constitution of an inkjet printer according to the embodiment.

Next, an inkjet printer 200 (hereinafter, simply referred to as a printer 200) loaded with such the head 100 is described. FIG. 6 is a block diagram illustrating a hardware constitution of the printer 200. The printer 200 is applied to, for example, a printer for office, a printer for barcode, a printer for POS and a printer for industry.

The printer 200 includes a CPU (Central Processing Unit) 201, a ROM (Read Only Memory) 202, a RAM (Random Access Memory) 203, an auxiliary storage device 204, a communication interface 205, an operation panel 206, an I/O port 207, a conveyance motor 208, a motor drive circuit 209, a pump 210, a pump drive circuit 211 and a head 100. Further, the printer 200 includes a bus line 212 such as an address bus and a data bus. Then, the printer 200 connects the bus line 212 with the CPU 201, the ROM 202, the RAM 203, the auxiliary storage device 204, the communication interface 205, the I/O port 207, the motor drive circuit 209, the pump drive circuit 211 and the drive circuit 101 of the head 100 directly or via an input/output circuit.

The CPU 201 acts as a central part of a computer. The CPU 201 controls each section for realizing various functions as the printer 200 according to an operating system and an application program.

The ROM 202 acts as a main storage part of the computer. The ROM 202 stores the operating system and the application program. There is a case in which the ROM 202 stores a data required for executing a processing by the CPU 201 to control each section.

The RAM 203 also acts as a main storage part of the computer. The RAM 203 stores a data required for executing a processing by the CPU 201. The RAM 203 is also used as a working area in which information is properly rewritten by the CPU 201. The working area includes an image memory in which print data is copied or decompressed.

The auxiliary storage device 204 is equivalent to an auxiliary storage section of the computer. For example, an HDD (Hard Disc Drive), an SSD (Solid State Drive) or an EEPROM (Electric Erasable Programmable Read-Only Memory) is used as the auxiliary storage device 204. The auxiliary storage device 204 stores data used by the CPU 201 which carries out various processing, and data generated in the processing by the CPU 201. There is a case in which the auxiliary storage device 204 stores the application program described above. The auxiliary storage device 204 stores a correction data memory 220. The correction data memory 220 is an area that stores correction data set for each channel (each nozzle) of the head 100.

The communication interface 205 carries out data communication with an information processing apparatus 300 connected therewith via a communication line 400 such as a LAN (Local Area Network) according to a preset communication protocol. The information processing apparatus 300 is computer equipment such as a general-purpose personal computer and a general-purpose tablet terminal. The information processing apparatus 300 includes a generating unit 301 of the correction data. The correction data generating unit 301 is realized by hardware such as a processor and a memory included in the information processing apparatus 300 and a dedicated application program installed in the information processing apparatus 300. Details of the correction data generating unit 301 are described later.

The operation panel 206 includes an operation section and a display section. The operation section is arranged with function keys such as a power key, a paper feed key, an error release key and the like. The display section is capable of displaying various states of the printer 200. The operation panel 206 is connected with the bus line 212 via the I/O port 207. The I/O port 207 inputs a signal generated by an operation of the operation section from the operation panel 206. Further, the I/O port 207 outputs display data on the display section to the operation panel 206.

The motor drive circuit 209 controls the drive of the conveyance motor 208. The conveyance motor 208 functions as a drive source of a conveyance mechanism for conveying an image receiving medium such as a printing paper. If the conveyance motor 208 is driven, the conveyance mechanism starts the conveyance of the image receiving medium. The conveyance mechanism conveys the image receiving medium to the printing position of the head 100. The conveyance mechanism discharges the printed image receiving medium to the outside of the printer 200 from a discharge port (not shown).

The pump drive circuit 211 controls the drive of the pump 210. If the pump 210 is driven, the ink in an ink tank (not shown) is supplied to the head 100.

The head drive circuit 101 drives a channel group 102 of the head 100 on the basis of the print data. The channel group 102 includes n channels ch.1, . . . , ch.i, ch.j, . . . , ch.n ($1< \ldots <i<j \ldots <n$: ch.1~ch.n) from channel number 1 to channel number n as shown in FIG. 7.

Figure 7:
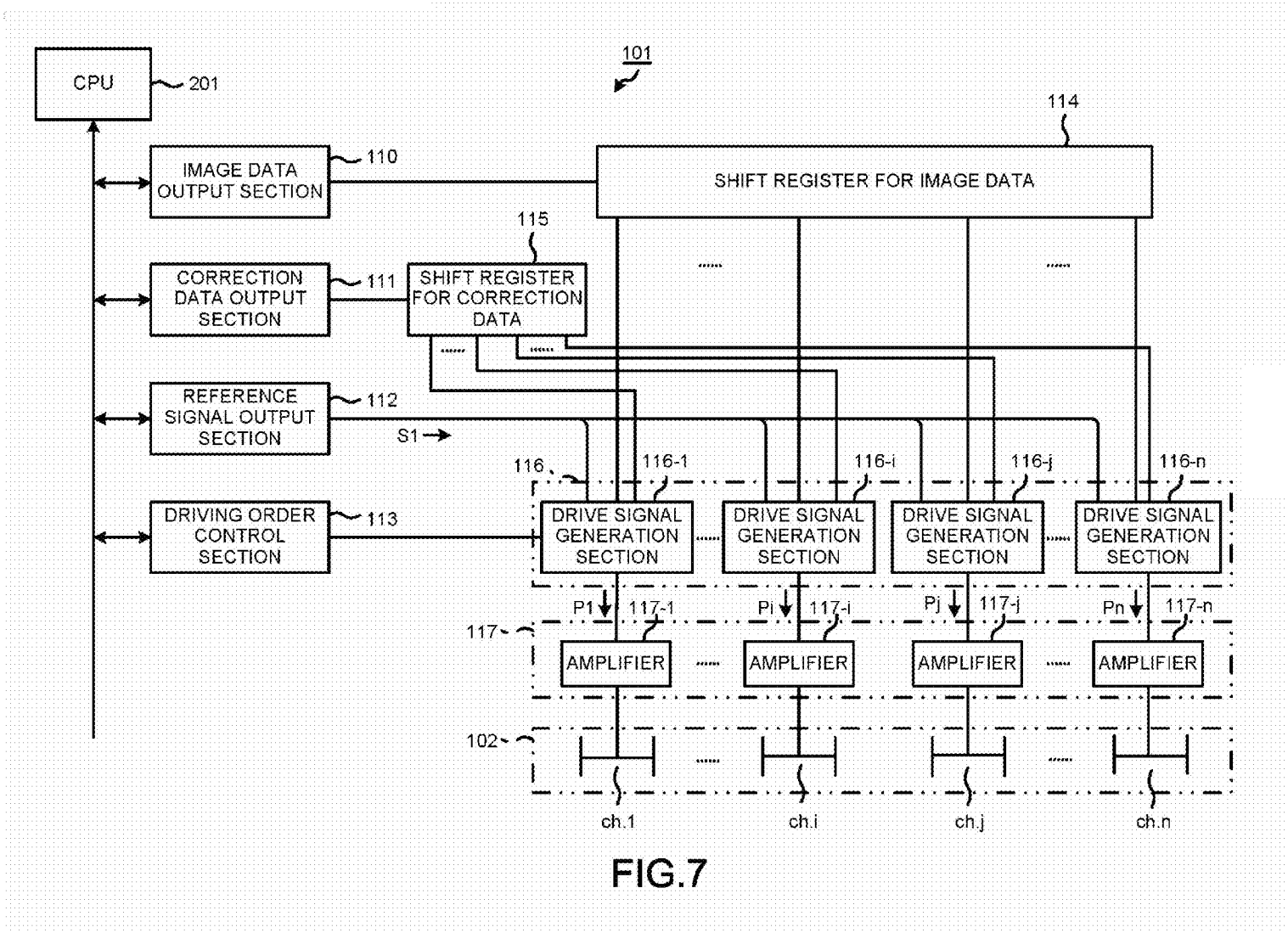
FIG. 7 is a block diagram illustrating the constitution of a head drive circuit of the inkjet head loaded on the inkjet printer.

FIG. 7 is a block diagram illustrating a constitution of main portion of the head drive circuit 101. The head drive circuit 101 is equipped with an image data output section 110, a correction data output section 111, a reference signal output section 112, a driving order control section 113, a shift register for image data 114, a shift register for correction data 115, a plurality of drive signal generation sections 116 (116-1, . . . , **116-*i*, 116-*j*, . . . , 116-*n*), and a plurality of amplifiers 117 (117-1, . . . , 117-*i*, 117-*j*, . . . , 117-*n*). Each of the drive signal generation sections 116 and each of the amplifiers 117 are provided corresponding to each of channels ch.1~ch.n of the inkjet head 100**.

The image data output section 110 reads out image data from the image memory of the RAM 203 line by line, and outputs the read image data to the shift register for image data 114. The shift register for image data 114 has a register length corresponding to each of the channels ch.1~ch.n of the inkjet head 100 one to one, and sequentially shifts and holds the image data of one line per pixel.

The correction data output section 111 reads out correction data of each of the channels ch.1~ch.n stored in the correction data memory 220, and outputs the read correction data to the shift register for correction data 115. The shift register for correction data 115 has a register length corresponding to each of the channels ch.1~ch.n of the inkjet head 100 one to one, and sequentially shifts and holds the correction data of one line per pixel.

The reference signal output section 112 outputs a reference signal S1 having a waveform serving as a reference of the drive pulse signal for enabling a drive element of the inkjet head 100 to operate. The driving order control section 113 controls an output timing of each of drive pulse signals P1, . . . Pi, Pj, . . . , Pn (P1~Pn) generated for each of the channels ch.1~ch.n by each of the drive signal generation sections 116 such that the ink is ejected in order from the nozzles 8 of the pressure chambers 15 at both sides which share a partition wall.

Each of the drive signal generation sections 116 includes a reference signal input section for inputting the reference signal S1, an image data input section for inputting the image data, a correction data input section for inputting the correction data, and an output section for outputting the drive pulse signal. The drive signal generation sections 116 separately generate the drive pulse signals P1~Pn to be applied to the electrodes 4 of the respectively corresponding channels ch.1~ch.n according to the reference signal S1 and the image data stored in the shift register for image data 114. At this time, the drive signal generation sections 116 respectively correct the drive pulse signals P1~Pn for each of the channels ch.1~ch.n according to the correction data stored in the shift register for correction data 115. The drive pulse signals P1~Pn corrected according to the correction data are respectively applied to the electrodes 4 of the corresponding channels ch.1~ch.n after being respectively amplified by the amplifiers 117.

Figure 8:
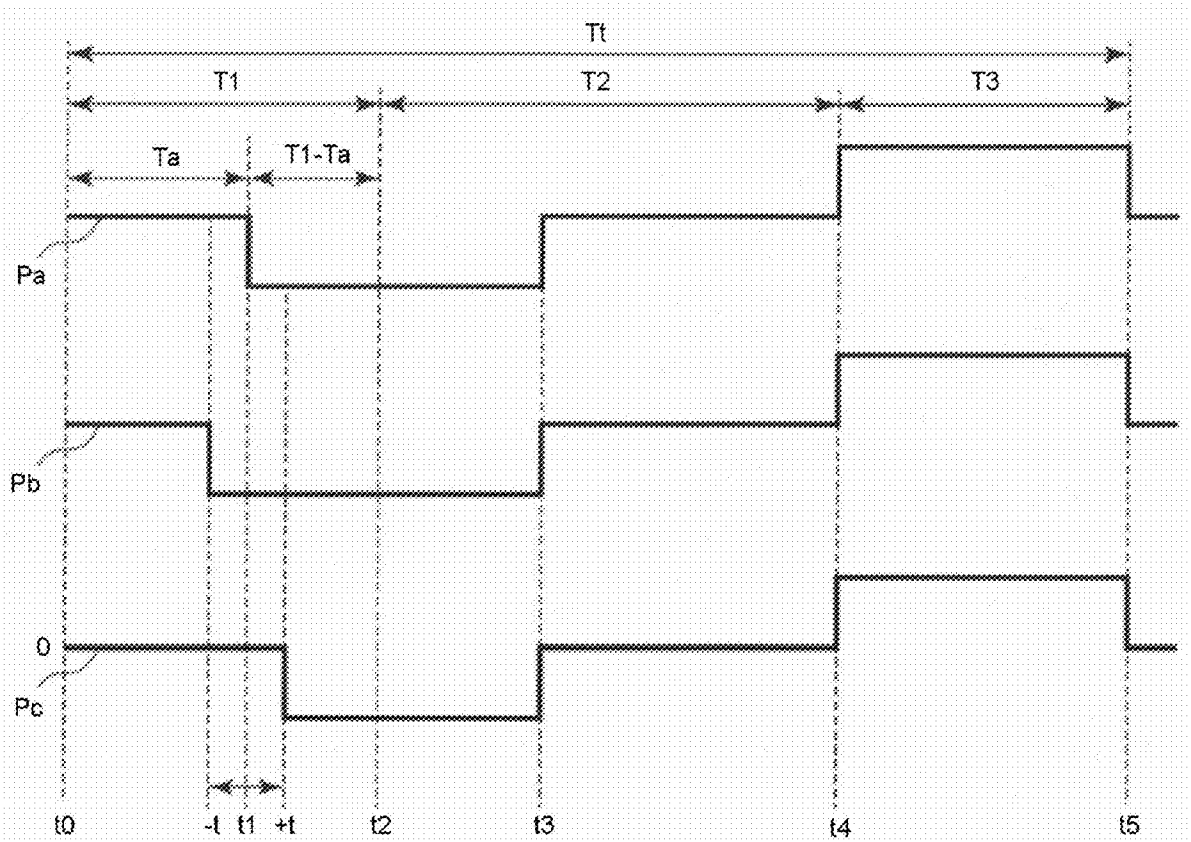
FIG. 8 is a waveform diagram illustrating a correction method of the drive pulse signal.

A correction method of the drive pulse signals P1~Pn is described with reference to FIG. 8. In FIG. 8, pulse waveforms Pa, Pb and Pc are all waveforms of the drive pulse signal applied to the electrode 4 corresponding to the pressure chamber **15*b* serving as the ink ejection object. The pulse waveform Pa is the uncorrected waveform, and the pulse waveform Pb and the pulse waveform Pc are corrected waveforms. The pulse waveform Pa is coincident with the standard pulse waveform indicated as the drive pulse signal applied to the pressure chamber 15*b* in FIG. 5**.

As can be seen by comparing the pulse waveforms Pa, Pb and Pc, in the present embodiment, the preparation time T1 of the standard pulse waveform required for the ejection of the ink drop of one drop is corrected. Specifically, the point in time t1 for switching from the stationary time Ta to the expansion time (T1−Ta) in the preparation time T1 is varied within a range from time "−t" to "+t" according to the correction data. The ejection time T2 and the post processing time T3 are not corrected.

If the stationary time Ta is shortened, in other words, if the point in time t1 is corrected in the direction of "−t", the expansion time (T1−Ta) becomes long. As a result, the volume of the ink drop ejected from the nozzle 8 is increased. If the stationary time Ta is lengthened, in other words, if the point in time t1 is corrected in the direction of "+t", the expansion time (T1−Ta) becomes short. As a result, the volume of the ink drop ejected from the nozzle 8 is decreased. The correction data is data for setting how far the point in time t1 is shifted in the direction of "−t" or in the direction of "+t".

Figure 9:
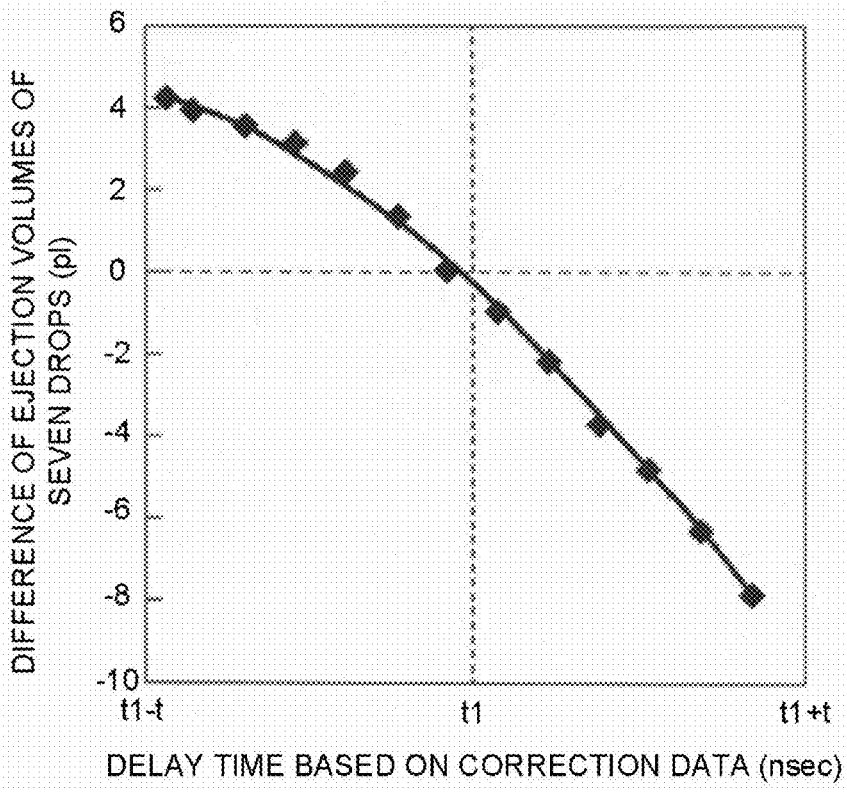
FIG. 9 is a characteristic view illustrating a correspondence relation between an ejection volume and delay time which is used for describing the correction method of the drive pulse signal.

FIG. 9 is a graph illustrating a correspondence relation between an ejection volume (vertical axis) in a case in which ink drops of seven drops are ejected from the nozzle 8 and delay time (horizontal axis) every time the point in time t1 is gradually delayed within the range from time "−t" to "+t". The ejection volume (p1) of the vertical axis illustrates a difference to an ejection volume at the time the point in time t1 is not corrected. As can be seen from the graph in FIG. 9, the relation between the ejection volume (p1) and the delay time (nsec) is a characteristic function: the larger the delay time (nsec) is, the smaller the ejection volume (p1) is.

In this manner, the ejection amount of the ink drops ejected respectively from each of the channels ch.1~ch.n can be adjusted by correcting the point in time t1 of each of the drive pulse signals P1~Pn for each of the channels ch.1~ch.n in a direction (+direction) of delaying the point in time t1 or in a direction (−direction) of quickening the point in time t1. In other words, by setting positive or negative correction time t (nsec) with respect to the point in time t1 for each of the channels ch.1~ch.n as the correction data, the ejection amount of the ink drops ejected from the respective nozzles 8 can be uniform. If the ejection amount becomes uniform, density unevenness is eliminated. Further, a difference in level of densities is not generated either at a border between a first head and a second head which are arranged in the arrangement direction of the nozzles 8.

The correction data (correction time t (nsec)) of each of the channels ch.1~ch.n is set in the correction data memory 220 by the correction data generating unit 301 included in the information processing apparatus 300. Hereinafter, the correction data generating unit 301 is described in detail.

Figure 10:
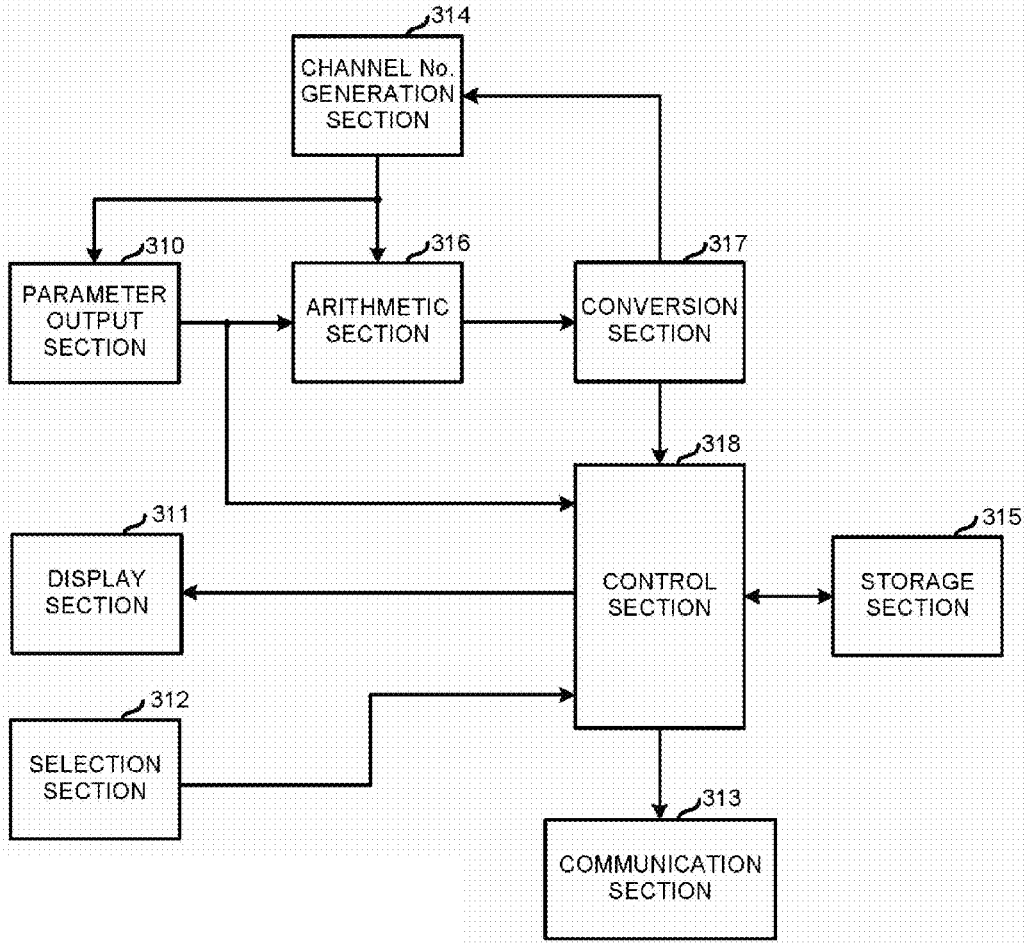
FIG. 10 is a block diagram illustrating a circuit constitution necessary for realization of a correction data generating function.

FIG. 10 is a block diagram illustrating a circuit constitution required for realization of the correction data generating unit 301. The correction data generating unit 301 needs a parameter output section 310, a display section 311, a selection section 312, a communication section 313, a channel No. generation section 314, a storage section 315, an arithmetic section 316, a conversion section 317 and a control section 318. The parameter output section 310, the display section 311 and the selection section 312 are realized mainly by an input device (a keyboard, a touch panel and the like) and a display device (a display, a touch panel and the like) which are included in the information processing apparatus 300. The communication section 313 is realized mainly by a communication interface (a LAN controller, a USB interface and the like) included in the information processing apparatus 300. The channel No. generation section 314 and the storage section 315 are realized mainly by a volatile memory (a RAM, an auxiliary storage device and the like) included in the information processing apparatus 300. The arithmetic section 316, the conversion section 317 and the control section 318 are realized mainly by a processor (a CPU, a MPU and the like) and a program memory (a ROM, an auxiliary storage device and the like) which are included in the information processing apparatus 300.

The parameter output section 310 includes a parameter table. A plurality of parameters a for determining strength of correction is stored in the parameter table by an operator who executes correction data setting work. The parameter output section 310 outputs the plurality of the parameters a (a1, a2, . . . ) stored in the parameter table to the arithmetic section 316 and the control section 318 in order. The type of the parameters a is not limited to one. A plurality of types of parameters may be stored in the parameter table, and output to the arithmetic section 316 and the control section 318.

The display section 311 displays a list of the parameters a set in the parameter table. The list is created by the control section 318. The display section 311 displays the list of the parameters a created by the control section 318.

The selection section 312 receives a selection input of any one of the parameters a from the list displayed on the display section 311. In a case in which there is a plurality of types of parameters a, the selection section 312 receives the selection input of any one of the parameters a for each type. When the display section 311 is a touch panel, the selection section 312 receives a signal indicating a touch position coordinate from the touch panel. If the signal is input through a touch operation to the list by the operator, the selection section 312 determines that the parameter a on the list displayed at the touch position is the selected one.

The communication section 313 sends various commands to the printer 200. The commands include a test command for instructing temporary setting of correction data and printing of test data and a setting command for instructing formal setting of the correction data. The correction data to be set temporarily and the number of times of printing of the test data are included in the test command. The test data is data for solid printing typically. The correction data set in the correction data memory 220 of the printer is included in the setting command. The correction data is obtained by associating channel numbers "1"~"n" of the channels ch.1~ch.n with the correction time t (nsec) for the channels ch.1~ch.n corresponding to the channel numbers "1"~"n".

The channel No. generation section 314 generates channel No.i from "1" to "n". The channel No. generation section 314 generates channel No.i in ascending order from "1" to "n". Alternatively, the channel No. generation section 314 generates channel No.i in descending order from "n" to "1". The channel No. generation section 314 may generate channel No.i from "1" to "n" randomly. The channel No. generation section 314 instructs the parameter output section 310 to output the next parameter a if completing the generation of the channel No.i from "1" to "n". In response to the instruction described above, the parameter output section 310 outputs one parameter a that is stored in the parameter table and is not output yet to the arithmetic section 316 and the control section 318. Then, if the output of all the parameters a stored in the parameter table is completed, the parameter output section 310 notifies the arithmetic section 316 and the control section 318 of the completion of the output.

The storage section 315 stores correction data tables TA (TA1, TA2, . . . ) by the parameters a (a1, a2, . . . ) as shown in FIG. 11. The correction data table TA includes an area in which a parameter a is stored and an area in which a pair of data consisting of channel No.i and correction time t (nsec) is stored.

Figure 12:
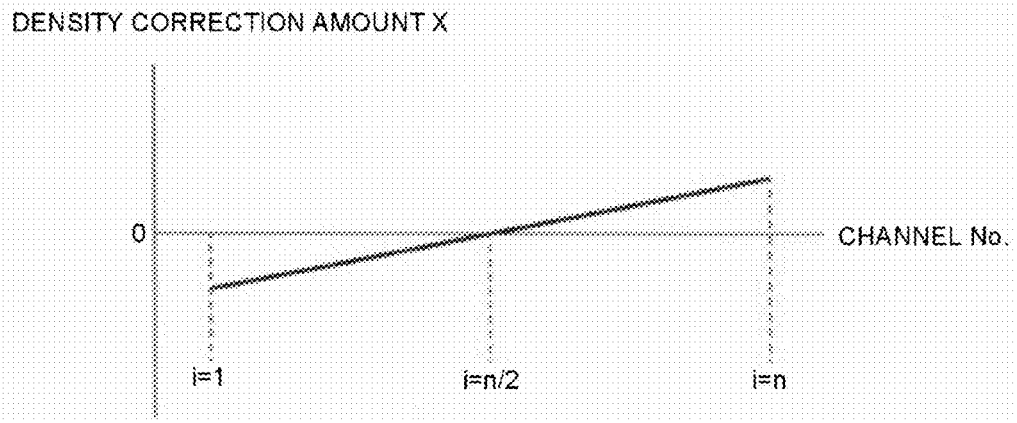
FIG. 12 is a linier profile of density correction amount vs. channel number used for description of a correction arithmetic expression executed by an arithmetic section in FIG. 10.

The arithmetic section 316 calculates a correction density amount X for channel ch.i identified by channel No.i by a predetermined correction arithmetic expression with the parameter a and the channel No.i. The correction arithmetic expression is not limited in particular. For example, as shown in FIG. 12, the density correction amount X for the channel ch.i (i=n/2) at the substantially center of the head 100 is set to "0", a correction arithmetic expression of linear approximation for correcting density linearly with respect to a direction in which the channel No.i is increased from "1" to "n" (in the arrangement direction of the nozzles 8) may be adopted. The correction arithmetic expression of linear approximation is represented by a formula (1).

$$X=a(i-(n/2)) \tag{1}$$

In other words, in a case in which the parameter a is a positive value, the straight line is inclined in the rightupward direction in which the density correction amount X also becomes large as the channel No.i becomes large; on the other hand, in a case in which the parameter a is a negative value, the straight line is inclined in a right-downward direction in which the density correction amount X becomes small as the channel No.i becomes large. That is, the larger the absolute value of the parameter a is, the larger the inclination of the straight line is. Such the correction arithmetic expression of linear approximation can correct non-uniformity of density for the head 100, wherein the nonuniformity refers to that the print density at one end part side is highest and the print density at the other end part side is lowest with respect to the arrangement direction of the nozzles 8.

Figure 13:
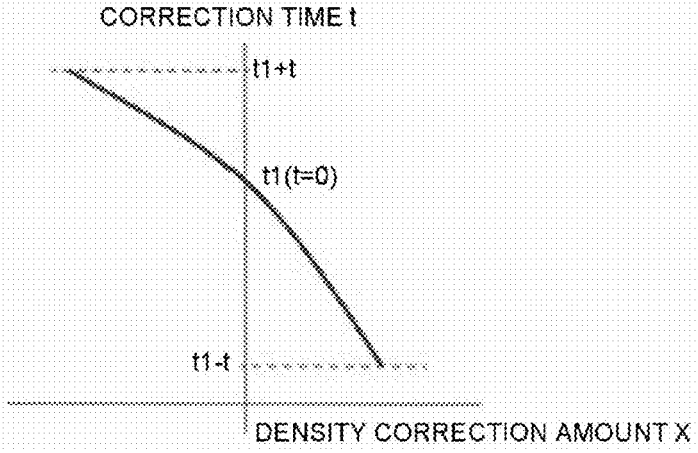
FIG. 13 is a characteristic view illustrating a conversion table used by a conversion section in FIG. 10.

The conversion section 317 converts the density correction amount X calculated by the arithmetic section 316 to the correction time t (nsec). The conversion table having a characteristic function of the graph shown in FIG. 13 is used in the conversion. The characteristic function of the conversion table is obtained from the characteristic function of the graph shown in FIG. 9. In other words, in FIG. 9, if the horizontal axis (delay time) is set to x and the vertical axis (difference of ejection volumes) is set to y, each point on the graph is represented by a coordinate (x, y). On the other hand, since the conversion table converts the density correction amount X to the correction time t (nsec), the horizontal axis is set to the density correction amount X and the vertical axis is set to the correction time t (nsec) as shown in FIG. 13. Then, the coordinate (x, y) of each point on the graph shown in FIG. 9 is replaced to the coordinate (y, x). In other words, the value of y coordinate is set to the density correction amount X of the conversion table and the value of x coordinate is set to the correction time t (nsec) of the conversion table. In this way, the conversion table shown in FIG. 13 is created from the graph shown in FIG. 9.

The conversion section 317 converts the density correction amount X for the channel No.i to the correction time t (nsec) for the channel No.i using the characteristic function of the conversion table. Then, the conversion section 317 outputs the pair of data consisting of the channel No.i and the correction time t (nsec) to the control section 318. Further, the conversion section 317 instructs the channel No. generation section 314 to update. In response to the instruction described above, the channel No. generation section 314 generates the next channel No.i. If the new channel No.i is generated, the arithmetic section 316 calculates the density correction amount X from the channel No.i and the parameter a. If the density correction amount X is calculated, the conversion section 317 converts the density correction amount X to the correction time t (nsec). Then, the conversion section 317 outputs the pair of data consisting of the channel No.i and the correction time t (nsec) to the control section 318. In this way, the correction time t (nsec) by the channel No.i for one parameter a output from the parameter output section 310 is obtained by actions of the channel No. generation section 314, the arithmetic section 316 and the conversion section 317.

The control section 318 inputs the parameter a from the parameter output section 310. Further, the control section 318 inputs the pair of data consisting of the channel No.i and the correction time t (nsec) from the conversion section 317. The input sequence is as follows: firstly, the parameter a is input, and next, the pair of data consisting of the channel No.i from the channel No."1" to "n" and the correction time t (nsec) for the channel No.i is input.

If the initial parameter a1 is input, the control section 318 creates the correction data table TA1 which stores this parameter a1 in the storage section 315. After that, the control section 318 stores the pair of data in the correction data table TA1 each time the pair of data consisting of the channel No.i and the correction time t (nsec) is input.

If the next parameter a2 is input, the control section 318 creates the correction data table TA2 which stores this parameter a2 in the storage section 315. After that, the control section 318 stores the pair of data in the correction data table TA2 each time the pair of data consisting of the channel No.i and the correction time t (nsec) is input. Even in a case in which the next parameter a3 is input, the control section 318 operates in the same way as above.

If receiving the notification of the completion of the output from the parameter output section 310, the control section 318 stores the correction data table TAx created last in the storage section 315. After that, the control section 318 instructs the communication section 313 to output the correction data tables TA1, TA2, . . . , TAx stored in the storage section 315 to the printer 200 in the creation order.

In response to the instruction described above, the communication section 313 instructs the control section 318 to read out the correction data. In response to the instruction described above, the control section 318 reads out the correction data table TA1 created firstly from the storage section 315, and outputs the correction data table TA1 to the communication section 313. The communication section 313 creates a test command including the correction data table TA1 received from the control section 318, and outputs the created test command to the printer 200 via the communication line 400.

The printer 200 receiving the test command sets the correction data (pair of data group consisting of the channel No.i and the correction time t (nsec)) of the correction data table TA included in the command in the correction data memory 220. Then, the printer 200 corrects the point in time t1 for switching from the stationary time Ta to the expansion time (T1−Ta) of the standard pulse waveform for each channel I with this correction data, and carries out the test print of the solid image.

The control section 318 next reads out the correction data table TA2 created secondly from the storage section 315, and outputs the correction data table TA2 to the communication section 313. The communication section 313 creates a test command including the correction data table TA2 received from the control section 318, and outputs the created test command to the printer 200 via the communication line 400. Later, the control section 318 repeats a processing for reading out the correction data tables TA (TA3, TA4, . . . ) sequentially to output the read correction data tables TA to the communication section 313, and the communication section 313 repeats a processing for creating the test command including the correction data table TA received from the control section 318 to output the created test command to the printer 200. Then, the control section 318 creates a list of the parameters a received from the parameter output section 310 and displays the list on the display section 311 if outputting the correction data table TAx created last to the communication section 313.

The operator who confirms the list of the parameters a selects a parameter a with which a proper correction data is obtained according to the result of the test print. If a parameter a is selected from the list, the selection section 312 notifies the control section 318 that the parameter a is selected. In response to the notification described above, the control section 318 reads out the correction data table TA in which the selected parameter a is set from the storage section 315, and outputs the correction data table TA to the communication section 313 and instructs the communication section 313 to carry out the formal setting of the correction data. In response to the instruction described above, the communication section 313 creates the setting command including the correction data table TA received from the control section 318, and outputs the created setting command to the printer 200 via the communication line 400.

The printer 200 receiving the setting command sets the correction data (pair of data group consisting of the channel No.i and the correction time t (nsec)) of the correction data table TA included in this command in the correction data memory 220. Then, the printer 200 corrects the point in time t1 for switching from the stationary time Ta to the expansion time (T1-Ta) of the standard pulse waveform for each channel i with this correction data to carry out the printing. Herein, the control section 318 and the communication section 313 function as setting sections that set the correction data in the correction data memory 220.

In this manner, by enabling the correction data generating unit to operate in the information processing apparatus 300, the test print is carried out by the printer 200 only corresponding to the number of the parameters a set in the parameter table. In other words, while the ejection amount of the ink ejected from the nozzle 8 of each channel is adjusted with the correction density amount X which is calculated by the channel No.i using the parameter a and the channel No.i, the operation for printing the solid image is repeated only corresponding to the number of the parameters a.

The operator can determine which parameter a is used when the correction data with which the density unevenness is generated the least is obtained from the result of the test print. If the operator selects the most suitable parameter a, the correction time t (nsec) for obtaining the correction density amount X which is calculated by the channel No.i on the basis of the most suitable parameter a is set in the correction data memory 220 of the printer 200. In this way, the operator can set the correction data for correcting the pulse width of the drive pulse signal applied to each of the actuators respectively corresponding to each of the nozzles 8 of the head 100 with easy work of setting the plurality of the parameters a and selecting the most suitable parameter a from the plurality of the parameters a.

Incidentally, it is necessary to change technique of the test print in a case in which the printer 200 is a serial printer and in a case in which the printer 200 is a line printer. For example, in a case in which the printer 200 is the serial printer, the density difference is not noticeable only by carrying out 1 path printing on the solid image for each parameter a, and it is difficult to select the most suitable parameter a. thus, in a case in which the printer 200 is the serial printer, at least 2 path printing, and preferably, 3 path printing is carried out on the same solid image at the width of the head 100. At this time, path intervals are close in such a manner that an interval between paths becomes equal to a dot interval of the head 100. By carrying out the printing in such a manner that the path intervals are close, provisionally, if the density is uniform, it looks like a uniform print on the whole surface, and the path interval cannot be distinguished. Thus, it is possible that a user easily determine whether or not the density is uniform.

Figure 14:
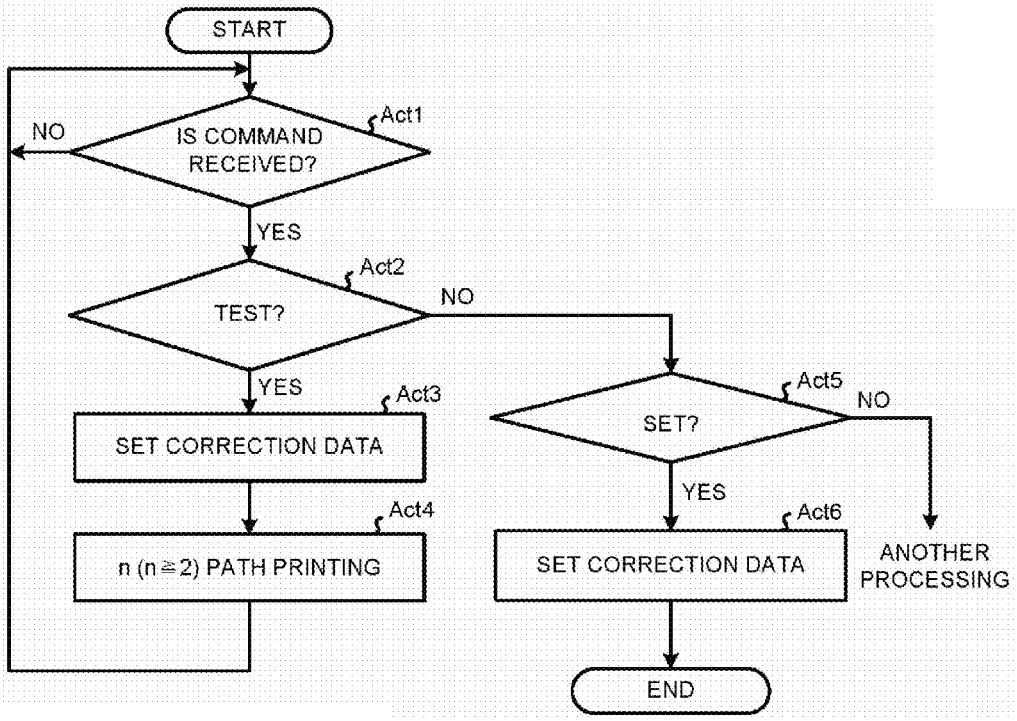
FIG. 14 is a flowchart illustrating the procedures of a test print processing executed by a CPU of a serial printer.

FIG. 14 is a flowchart illustrating the procedures of a test print processing executed by the CPU 201 in a case in which the printer 200 is the serial printer. The contents of the processing shown in FIG. 14 and described later are an example, and various processing capable of obtaining the same result can be suitably used.

Firstly, the CPU 201 waits for a command from the information processing apparatus 300 (Act 1). If receiving the command (YES in Act 1), the CPU 201 determines whether or not the command is the test command (Act 2). If the command is the test command (YES in Act 2), the CPU 201 sets the correction data of the correction data table TA included in the test command in the correction data memory 220 (Act 3). Then, the CPU 201 controls n (n≥2) path printing of the solid image using the correction data set in the correction data memory 220 (Act 4). If the n path printing is ended, the CPU 201 returns to the processing in Act 1 and waits for the next command. The CPU 201 repeatedly carries out the processing in Act 3 and Act 4 each time the test command is received.

On the other hand, if the received command is not the test command (NO in Act 2), the CPU 201 determines whether or not the received command is the setting command (Act 5). If the received command is the setting command, the CPU 201 sets the correction data of the correction data table TA included in the setting command in the correction data memory 220 (Act 6). Through the above, the CPU 201 ends the procedures of the test print processing.

Figure 15:
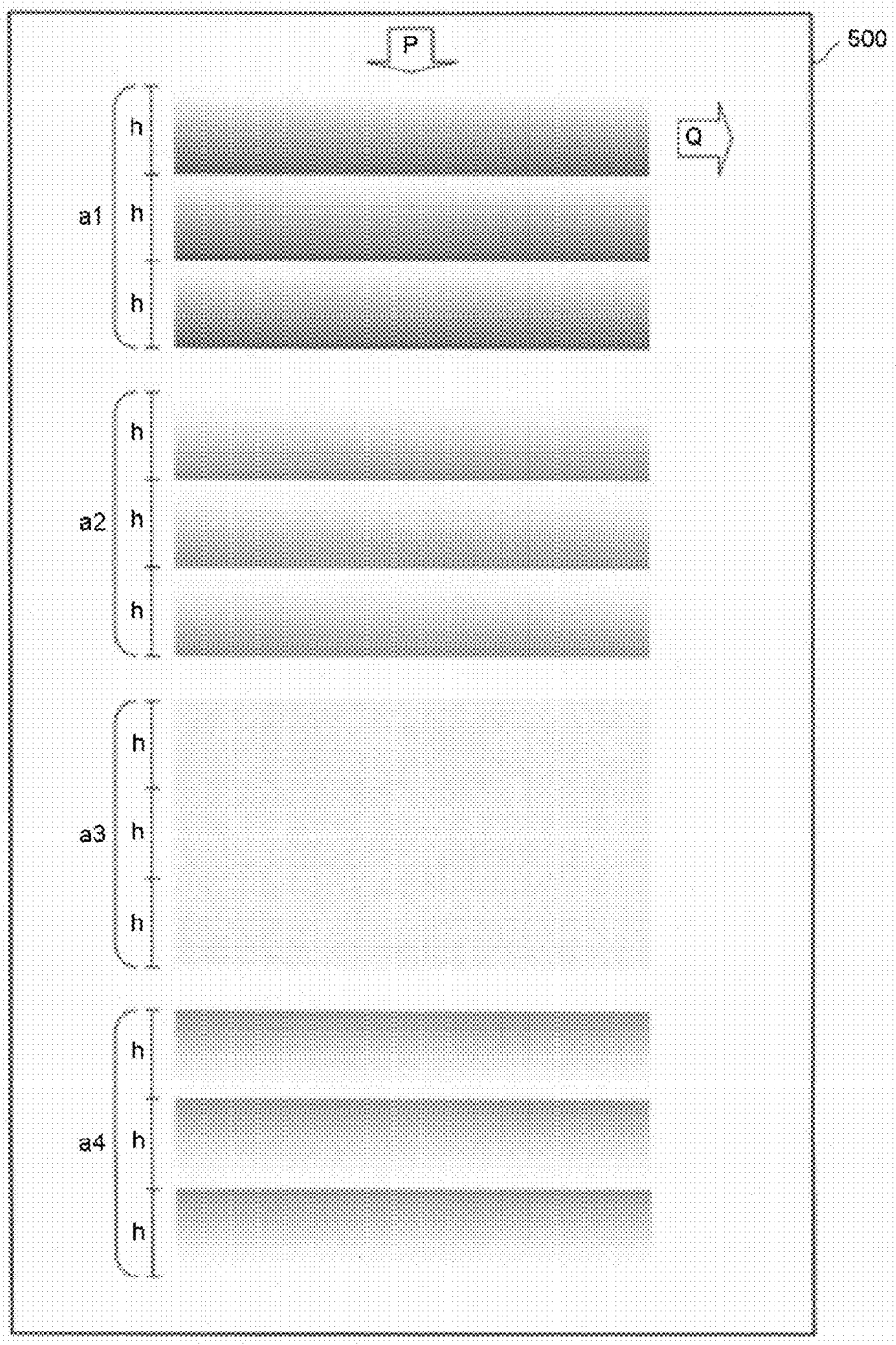
FIG. 15 is a diagram illustrating an example of an output of the test print executed by the serial printer.

In the serial printer, for example, a test print image 500 as shown in FIG. 15 is obtained with the execution of the test print processing indicated by the procedures shown in FIG. 14. The test print image 500 is a case in which there are four parameters a including a1 (correction inclination +1), a2 (correction inclination 0), a3 (correction inclination −1) and a4 (correction inclination −2) and a case in which the 3 path printing is carried out respectively on the solid images. In FIG. 15, an arrow p indicates the conveyance direction of the paper, an arrow q indicates the scanning direction of the inkjet head 100, and a symbol h indicates the width of the inkjet head 100.

As is obvious from FIG. 15, in a case in which the correction data is not suitable (in a case in which the parameter a is a1, a2 or a4), density differences are noticeable at a boundary between a first pass and a second path and a boundary between the second path and a third path by the 3 path printing. On the contrary, in a case in which the correction data is suitable (in a case in which the parameter a is a3), the density difference is not noticeable even at the boundary between paths. As a result, the operator easily selects the most suitable parameter a3.

On the other hand, in a case in which the printer 200 is the line printer which cannot carry out printing with the head moving, it is not possible to carry out the printing in which a right end and a left end of the head are adjacent using a plurality of paths like the case of the serial printer described previously. Thus, the solid images corresponding to the respective parameters a are continuously printed in the conveyance direction of the paper while the parameter a is changed. In the case of the line printer, the parameter a has to be changed without gaps in the test print; however, there is no time margin of receiving the next parameter a if the test print is started. Thus, the RAM 203 is used as the correction data memory for test print instead of the correction data memory 220, the test print is started after all the correction data tables TAn corresponding to the plurality of the parameters a are stored in the RAM 203 in advance. After the test print is ended and the correction data is determined, the correction data memory 220 in the auxiliary storage device is used in the correction data memory at the time of normal printing.

Figure 16:
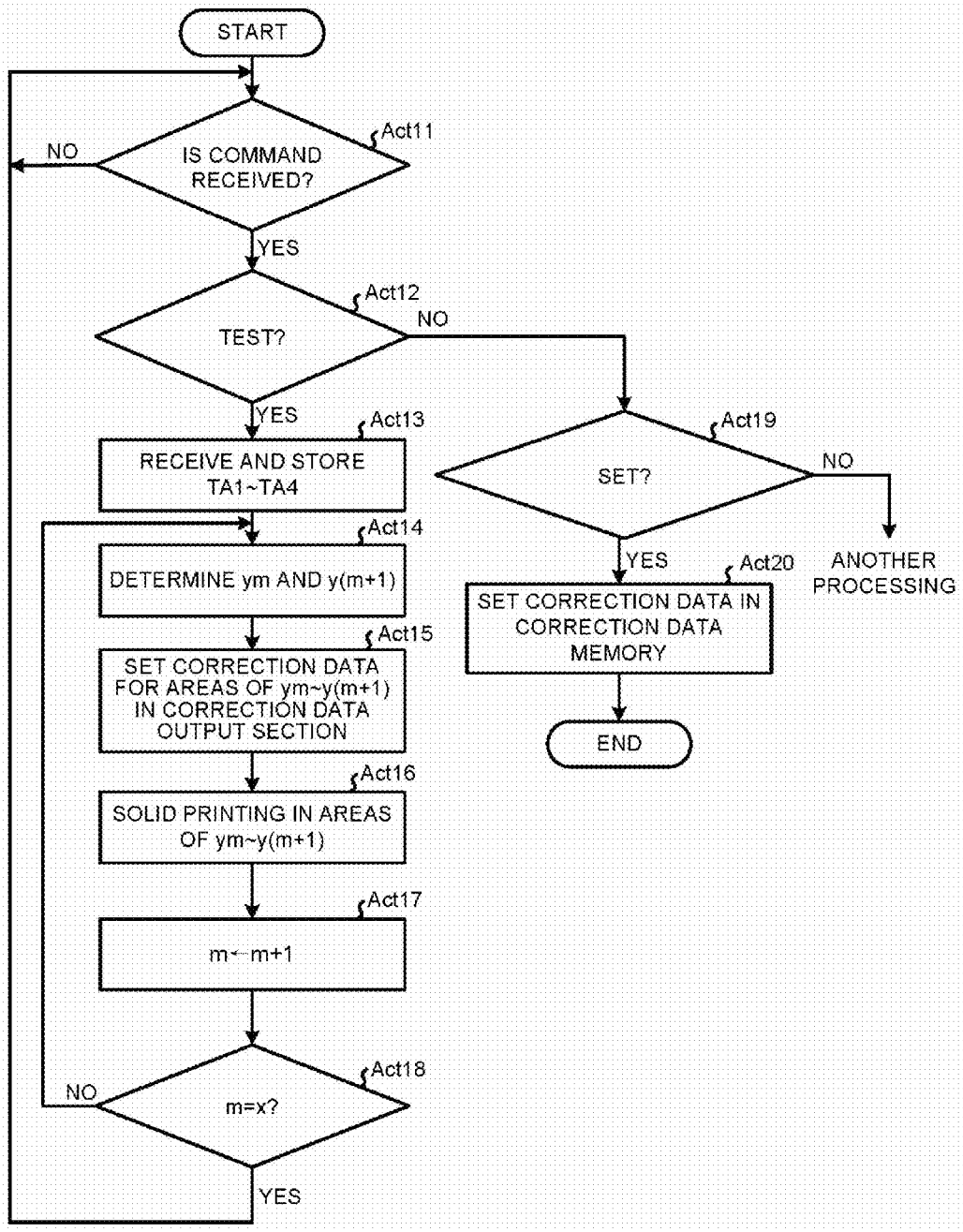
FIG. 16 is a flowchart illustrating the procedures of a test print processing executed by a CPU of a line printer.

FIG. 16 is a flowchart illustrating the procedures of a test print processing executed by the CPU 201 in a case in which the printer 200 is the line printer. The contents of the processing shown in FIG. 16 and described later are an example, and various processing capable of obtaining the same result can be suitably used.

Firstly, the CPU 201 waits for a command from the information processing apparatus 300 (Act 11). If receiving the command (YES in Act 11), the CPU 201 determines whether or not the command is the test command (Act 12). If the command is the test command (YES in Act 12), the CPU 201 receives the correction data tables TA1~TAx corresponding to the parameters a1~ax and stores the correction data tables TA1~TAx in the RAM 203 (Act 13). Next, the CPU 201 determines a headline ym and a last line y(m+1) of the print area (Act 14). Then, the CPU 201 reads out the correction data of a corresponding correction data table TA(m+1) from the RAM 203 as the correction data for the print area in which the head line ym and the last line y(m+1) are divided and sets the read correction data in the correction data output section 111 of the head drive circuit 101 (Act 15). m is a count value of which the initial value is 0.

Next, the CPU 201 starts solid printing between the headline ym and the last line y(m+1) (Act 16). If the last line y(m+1) is printed, the CPU 201 counts up the count value m by "1" (Act 17). Then, the CPU 201 determines whether or not the count value m reaches the greatest value "x" (Act 18). The greatest value "x" is the number of the correction data tables TA1, TA2, . . . , TAx created by the information processing apparatus 300. The greatest value "x" is notified to the printer 200 in advance together with, for example, the test command.

If the count value m does not reach the greatest value "x" (NO in Act 18), the CPU 201 returns to the processing in Act 14 to determine the head line ym and the last line y(m+1) of the next print area, and reads out the correction data of the corresponding correction data table TA(m+1) from the RAM 203 and sets the read correction data in the correction data output section 111 of the head drive circuit 101 to carry out the solid printing without a break. The CPU 201 repeatedly carries out the processing in Act 14 to Act 17 until the count value m reaches the greatest value "x". During this time, an interval in the paper feed direction between areas is equal to that between dots in the paper feed direction in the area. In other words, the CPU 201 has to carry out the processing in Act 16, Act 17, Act 14 and Act 15 within the time interval of successive dots. In a case in which the processing speed of the CPU 201 is smaller than this, all or part of the processing in Act 16, Act 17, Act 14 and Act 15 may be replaced with hardware. Alternatively, after the initial print area is printed, the paper is stopped and returns temporarily while the next print area is printed, and the next print area may be printed so that the next print area is connected with the initial print area without gaps. If the count value m reaches the greatest value "x" (YES in Act 18), the CPU 201 returns to the processing in Act 11 to wait for next command.

On the other hand, in a case in which the received command is not the test command (NO in Act 12), the CPU 201 determines whether or not the received command is the setting command (Act 19). If the received command is the setting command, the CPU 201 sets the correction data of the correction data table TA included in the setting command in the correction data memory 220 (Act 20). Through the above, the CPU 201 ends the procedures of the test print processing.

Figure 17:
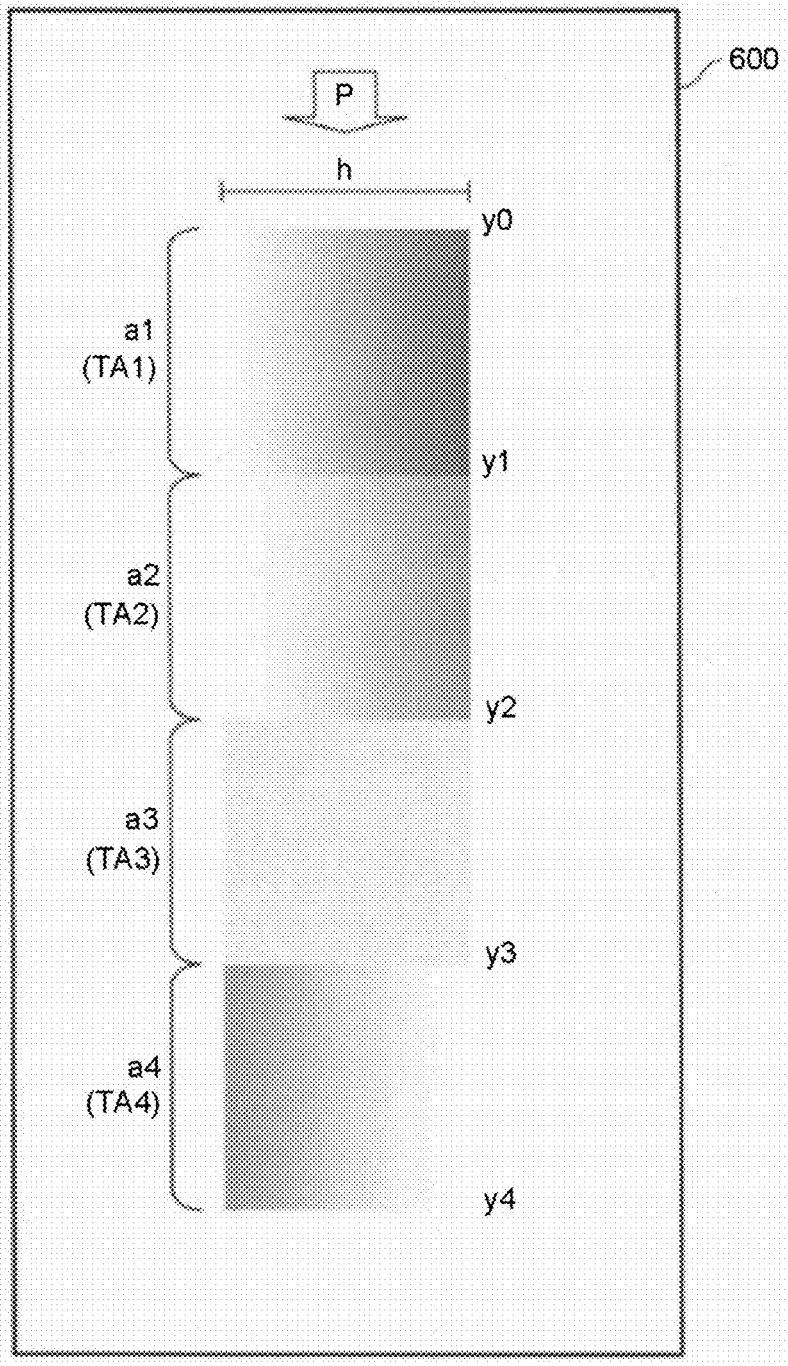
FIG. 17 is a diagram illustrating an example of an output of the test print executed by the line printer.

In the line printer, for example, a test print image 600 as shown in FIG. 17 is obtained with the execution of the test print processing indicated by the procedures shown in FIG. 16. The test print image 600 is a case in which there are four parameters a including a1 (correction inclination +1), a2 (correction inclination 0), a3 (correction inclination −1) and a4 (correction inclination −2) and a case in which the correction is carried out with the correction data set for each of the areas corresponding to each of the parameters a1, a2, a3 and a4 and 1 path printing is carried out on the solid image in each area. In FIG. 17, an arrow p indicates the conveyance direction of the paper, and a symbol h indicates the width of the inkjet head 100.

As is obvious from FIG. 17, by printing the solid images corrected with the correction data calculated using different parameters a in the order of the correction amount, printing (parameter a1 and parameter a2) becomes thick towards the right or printing (parameter a4) becomes thick towards the left in each area. It is difficult to distinguish which one of the left and the right is thick only by single printing; however, the distinction becomes relatively possible since there is a solid image to be compared which is printed without gaps just above or below. It can be presumed that the parameter a3 against the border between the printing which is thick towards the right and the printing which is thick towards the left is uniform printing if the printing is seen, and the operator is easy to select the most suitable parameter a3.

As stated in detail above, according to the correction data generating unit 301 of the present embodiment, it is possible to easily set the correction data for correcting the pulse width of the drive pulse signal applied to each of the actuators respectively corresponding to each of the nozzles 8 of the head 100. As a result, since there is no density unevenness caused by the dispersion in structure of the head 100, the inkjet printer capable of carrying out high-quality printing can be provided.

In the embodiment, a case of calculating the correction data with the linear approximation in the correction data generating unit 301 is exemplified. The calculation method of the correction data is not limited to the linear approximation. For example, a technology of spline interpolation for interpolating a density correction amount X to channel No.i with a spline curve passing through a plurality of control points may be used.

Figure 18:
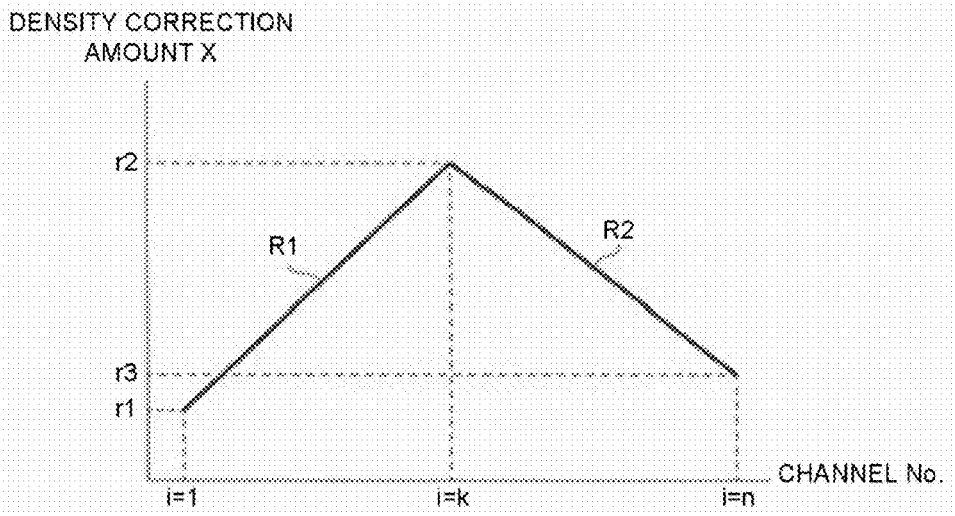
FIG. 18 is a linier spline profile of density correction amount vs. channel number used for description of another form of the correction arithmetic expression executed by the arithmetic section in FIG. 10.

FIG. 18 illustrates a spline curve of linear spline interpolation. The profile of the linear spline interpolation is a broken line consisting of a first straight line R1 and a second straight line R2. In this case, a density correction amount r1 to channel No.i=1 and a density correction amount r3 to channel No.i=n which are both ends of the broken line and a density correction amount r2 to channel No.i=k which is top of the broken line may be output as parameters from the parameter output section 310. The correction density amount X to channel ch.i is calculated by the arithmetic section 316 with an arithmetic expression of the spline interpolation using the channel No.i generated from the channel No. generation section 314 and three parameters r1, r2 and r3. The arithmetic expression of the linear spline interpolation is represented by a formula (2).

$$X=F(i,r1,r2,r3) \quad (2).$$

F (i, r1, r2, r3) is the linear spline function.

In a case of adopting the spline of the broken line shown in FIG. 18, the density correction amount X is interpolated with the first straight line R1 from the interpolation point (1, r1) of channel No. i=1 to the interpolation point (k, r2) of channel No.i=k. The density correction amount X is interpolated with the second straight line R2 from the interpolation point (k, r2) of channel No.i=k to the interpolation point (n, r3) of channel No.i=n.

Thus, the operator can just designate the three parameters r1, r2 and r3 to easily obtain correction data capable of correcting nonuniformity of density for the head 100, wherein the nonuniformity refers to the thinness of the print density at both-end part side and the thickness of the print density in the vicinity of the center with respect to the arrangement direction of the nozzles 8.

Figure 19:
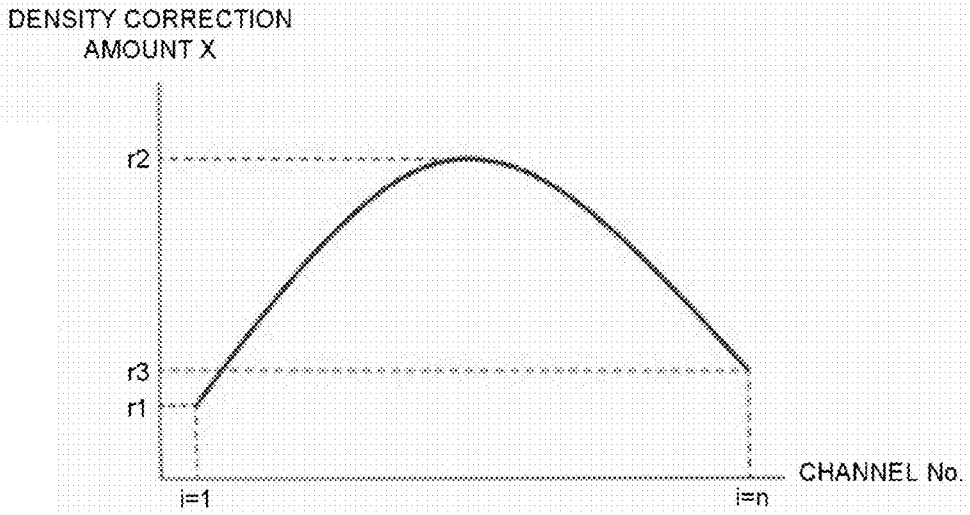
FIG. 19 is a spline profile of density correction amount vs. channel number used for description of another form of the correction arithmetic expression executed by the arithmetic section in FIG. 10.

The spline curve F (i, r1, r2, r3) of the broken line shown in FIG. 18 becomes a smooth mountain type curve by raising a degree as shown in FIG. 19. Correction data capable of correcting the nonuniformity of density more smoothly can be easily obtained by using the spline curve F (i, r1, r2, r3) of the mountain type.

Figure 20:
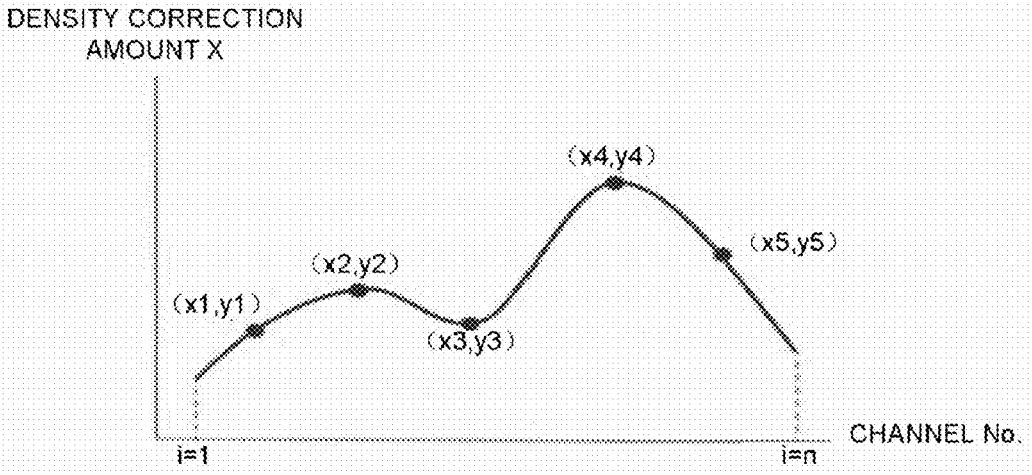
FIG. 20 is a spline profile of density correction amount vs. channel number used for description of another form of the correction arithmetic expression executed by the arithmetic section in FIG. 10.

Further, the spline curve F can also become a wave type by increasing interpolation points (x1, y1), (x2, y2), (x3, y3), (x4, y4) and (x5, y5) as shown in FIG. 20. In this case, each of the interpolation points (x1, y1), (x2, y2), (x3, y3), (x4, y4) and (x5, y5) may be output as parameters a from the parameter output section 310. Correction data capable of treating the nonuniformity of density can be easily obtained by using the spline curve F of the wave type, wherein the nonuniformity refers to the thickness of the print density of one part and the thinness of the print density of other parts with respect to the arrangement direction of the nozzles 8.

Incidentally, there is a case in which periodic density unevenness (periodic unevenness) is generated in a special direction by reason of wrinkles of a paper to be printed but not the reason of the manufacture of the head 100. In such a case, the density correction amount X may be calculated using a periodic function by the arithmetic section 316. Further, such the density unevenness is seldom generated across the whole area of the arrangement direction of the nozzles of the head 100 and is often generated across the partial area thereof. Thus, it is desired to determine a range within which the correction is applied using a window function.

Figure 21:
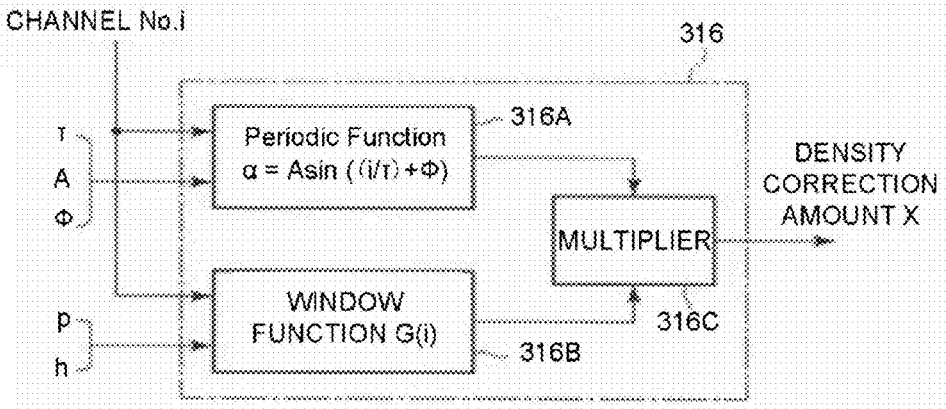
FIG. 21 is a circuit block diagram used for description of another form of the correction arithmetic expression executed by the arithmetic section in FIG. 10.

FIG. 21 is a block diagram illustrating a circuit constitution of the arithmetic section 316 using a periodic function and a window function. The arithmetic section 316 includes a periodic function arithmetic section 316A, a window function arithmetic section 316B and a multiplier 316C.

The periodic function arithmetic section 316A inputs a period τ, an amplitude A and a phase Φ as parameters from the parameter output section 310. Further, the periodic function arithmetic section 316A inputs channel No.i generated from the channel No. generation section 314. Then, the periodic function arithmetic section 316A calculates a periodic function value α for each channel No.i with a formula (3).

$$\alpha = A\sin((i/\tau)+\Phi) \tag{3}$$

Figure 22:
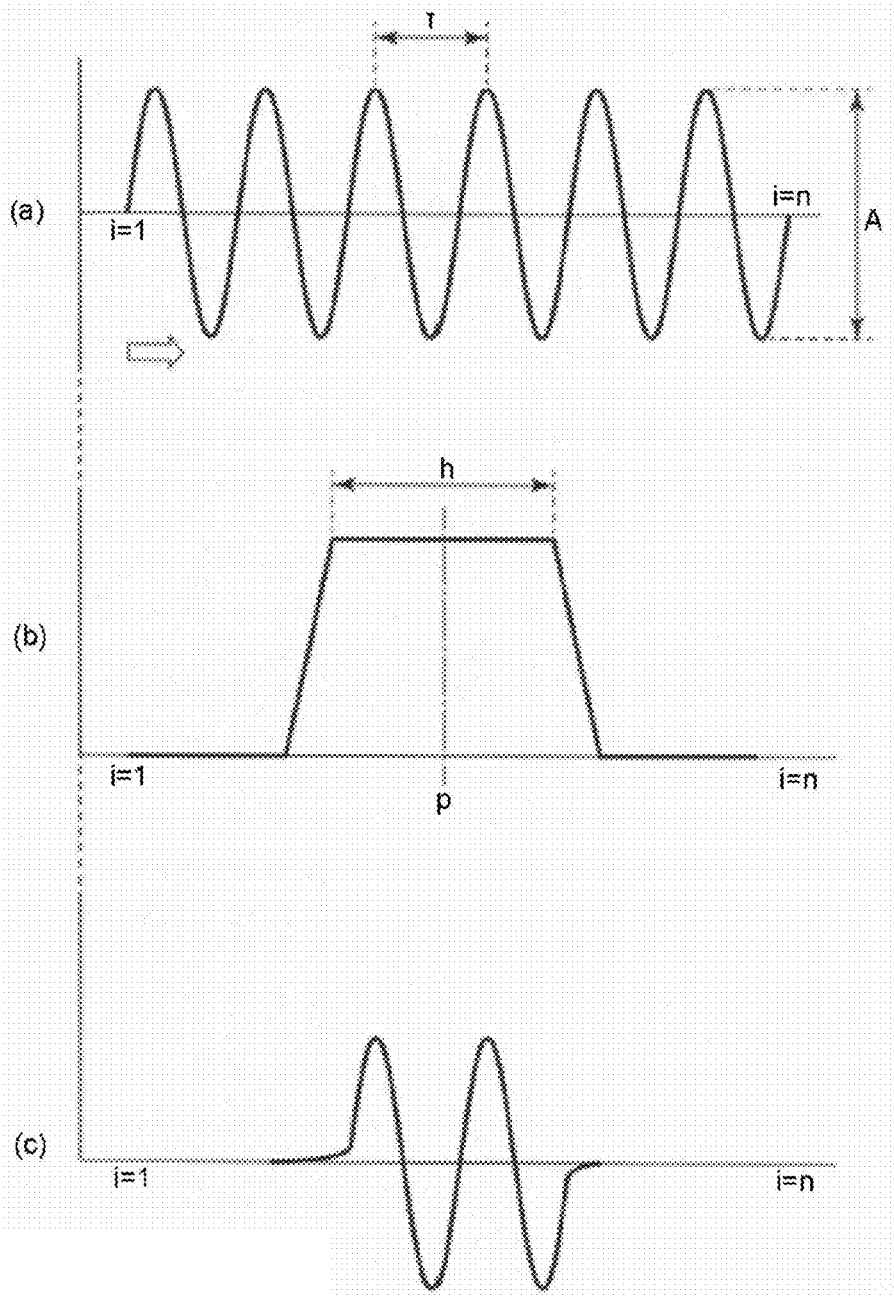
FIG. 22 is an example of an output profile of each circuit shown in FIG. 21.

Such a periodic function value α becomes a waveform shown in (a) in FIG. 22.

The window function arithmetic section 316B inputs a window position p and a window width h as parameters from the parameter output section 310. Further, the window function arithmetic section 316B inputs channel No.i generated from the channel No. generation section 314. Then, the window function arithmetic section 316B calculates a window function G(i) of which a finite section is the window width h centering on the channel No.i becoming the window position p as shown in FIG. 22(*b*).

The multiplier 316C multiplies the window function G(i) calculated by the window function arithmetic section 316B by the periodic function value α calculated by the periodic function arithmetic section 316A. As a result, the arithmetic section 316 outputs the periodic function value α in the finite section of the window function G(i) to the conversion section 317 as the density correction amount X as shown in FIG. 22(*c*).

In the case of the embodiment, the operator can easily obtain the correction data for correcting the periodic density unevenness in the spatial direction only by designating the period τ, the amplitude A and the phase Φ, and the window position p and the window width h as the parameters.

In the example shown in FIG. 21, the arithmetic section 316 calculates a periodic function value α consisting of a waveform in the case of a type of period τ in the finite section of the window function G(i). Furthermore, it is also possible to generate the correction data with different waveform shapes by calculating a periodic function value α obtained by adding a plurality of types of periods τ with the arithmetic section 316.

Figure 23:
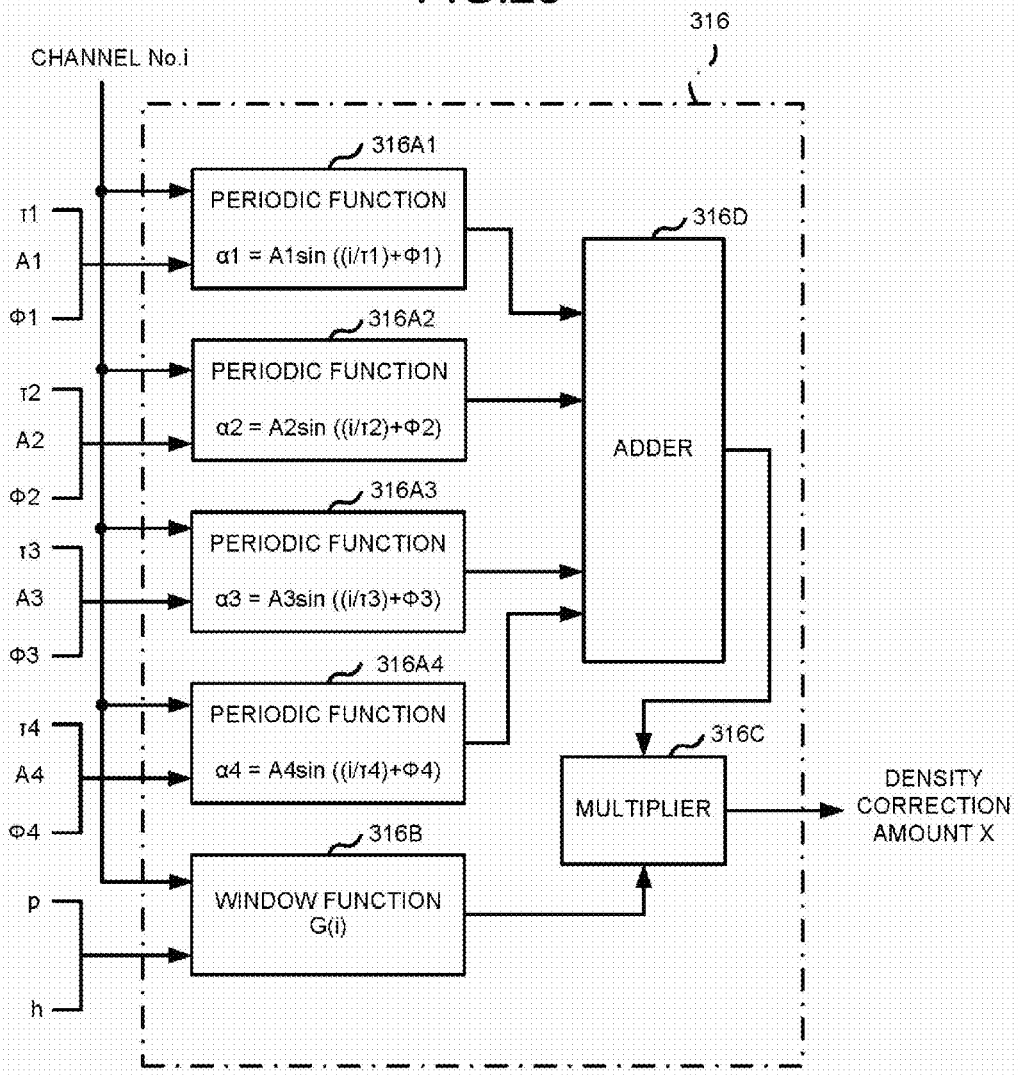
FIG. 23 is a circuit block diagram used for description of another form of the correction arithmetic expression executed by the arithmetic section in FIG. 10.

FIG. 23 is a block diagram illustrating a circuit constitution of the arithmetic section 316 in a case in which periods τ2, τ3 and τ4 are ½, ⅓ and ¼ of the period τ1 respectively. The arithmetic section 316 includes first to fourth periodic function arithmetic sections 316A1~316A4, a window function arithmetic section 316B, an multiplier 316C and an adder 316D.

The periodic function arithmetic section 316A1 inputs a period τ1, an amplitude A1 and a phase Φ1 as parameters from the parameter output section 310. Further, the periodic function arithmetic section 316A1 inputs channel No.i generated from the channel No. generation section 314. Then, the periodic function arithmetic section 316A1 calculates a periodic function value α1 for each channel No.i with a formula (4).

$$\alpha 1 = A1\sin((i/\tau 1)+\Phi 1) \tag{4}$$

The periodic function arithmetic section 316A2 inputs a period τ2, an amplitude A2 and a phase Φ2 as parameters from the parameter output section 310. Further, the periodic function arithmetic section 316A2 inputs channel No.i generated from the channel No. generation section 314. Then, the periodic function arithmetic section 316A2 calculates a periodic function value α2 for each channel No.i with a formula (5).

$$\alpha 2 = A2\sin((i/\tau 2)+\Phi 2) \tag{5}$$

The periodic function arithmetic section 316A3 inputs a period τ3, an amplitude A3 and a phase Φ3 as parameters from the parameter output section 310. Further, the periodic function arithmetic section 316A3 inputs channel No.i generated from the channel No. generation section 314. Then, the periodic function arithmetic section 316A3 calculates a periodic function value α3 for each channel No.i with a formula (6).

$$\alpha 3 = A3\sin((i/\tau 3)+\Phi 3) \tag{6}$$

The periodic function arithmetic section 316A4 inputs a period τ4, an amplitude A4 and a phase Φ4 as parameters from the parameter output section 310. Further, the periodic function arithmetic section 316A4 inputs channel No.i generated from the channel No. generation section 314. Then, the periodic function arithmetic section 316A4 calculates a periodic function value α4 for each channel No.i with a formula (7).

$$\alpha 4 = A4\sin((i/\tau 4)+\Phi 4) \tag{7}$$

The adder 316D adds the periodic function values α1, α2, α3 and α4 calculated by the respective periodic function arithmetic sections 316A1~316A4. The window function arithmetic section 316B is the same as that shown in FIG.

21. The multiplier 316C multiplies the window function G(i) calculated by the window function arithmetic section 316B by a total value of the periodic function values $\alpha 1$, $\alpha 2$, $\alpha 3$ and $\alpha 4$ calculated by the adder 316D. Then, the multiplier 316C outputs a multiplication result to the conversion section 317.

Further, it is also possible to combine the periodic density correction shown in FIG. 21 with the density correction by the spline curves F shown in FIG. 18, FIG. 19, and FIG. 20.

Figure 24:
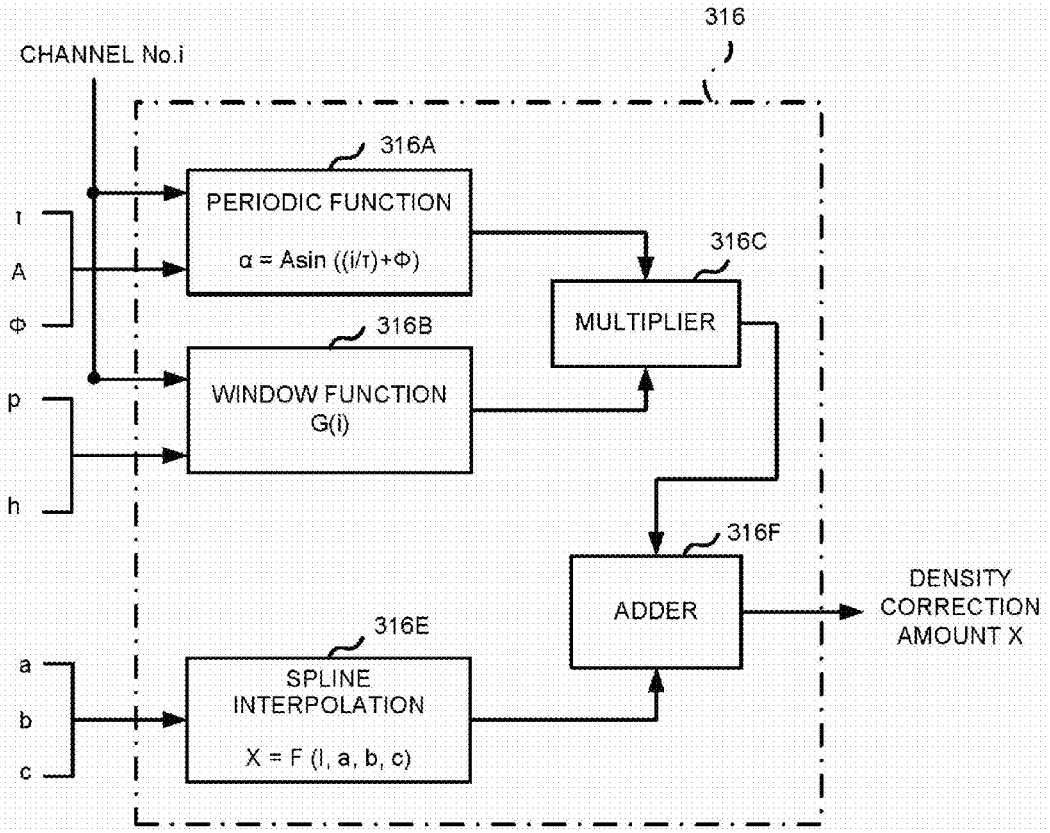
FIG. 24 is a circuit block diagram used for description of another form of the correction arithmetic expression executed by the arithmetic section in FIG. 10.

FIG. 24 is a block diagram illustrating a circuit constitution of the arithmetic section 316 in a case of combining the periodic density correction with the density correction by the spline curve F shown in FIG. 18 or FIG. 19. The arithmetic section 316 includes the periodic function arithmetic section 316A, the window function arithmetic section 316B and the multiplier 316C, a spline interpolation arithmetic section 316E for carrying out the arithmetic of the spline interpolation by the (2) formula for the parameters r1, r2 and r3, and an adder 316F. The adder 316F adds the output of the multiplier 316C and the output of the spline interpolation arithmetic section 316E. Then, the adder 316F outputs a density correction amount X serving as an addition result to the conversion section 317.

By the way, a case of combining the periodic density correction with the density correction by the spline curve F shown in FIG. 20 can also be suitable in the same circuit constitution only by changing a parameter output from the parameter output section 310 to the spline interpolation arithmetic section 316E.

The transfer of the information processing apparatus loaded with the correction data generating unit is carried out generally in a state in which a program P for realizing the correction data generating unit 301 is stored in the ROM. However, the present invention is not limited to this; the program P transferred separately from computer equipment may be written into a writable storage device included in the computer equipment in response to an operation of a user. The transfer of the program P can be recorded in a removable recording medium or be carried out through communication via a network. The recording medium can store the program P like a CD-ROM, a memory card and the like, and the form of the recording medium is not limited as long as the recording medium can be read by the apparatus. Further, a function obtained by installation or downloading of the program P may be realized by cooperating with an OS (Operating System) inside the apparatus.

The present invention is not limited to the foregoing embodiment. For example, in the embodiment, a case in which the information processing apparatus 300 includes the correction data generating unit 301 is described; however, the printer 200 may include the correction data generating unit 301. In this case, the program P for realizing the correction data generating function 301 is stored in the ROM 202 or the auxiliary storage device 204. At this time, each circuit in the correction data generating unit 301 has a function serving as each action. Further, the head drive circuit 101 may include the correction data generating unit 301.

Further, in the embodiment, a case in which the printer 200 includes the correction data memory 220 is described; however, the head 100 may include the correction data memory 220.

Further, in the embodiment, the image data output section 110, the correction data output section 111, the reference signal output section 112 and the driving order control section 113 are arranged in the head drive circuit 101 of the inkjet head 100; however, several or all of these sections may be arranged in other locations but not in the inkjet head 100 in the printer 200. Boundaries between the inkjet head 100, the head drive circuit 101 and other parts of the printer 200 can be optically obtained.

Figure 25:
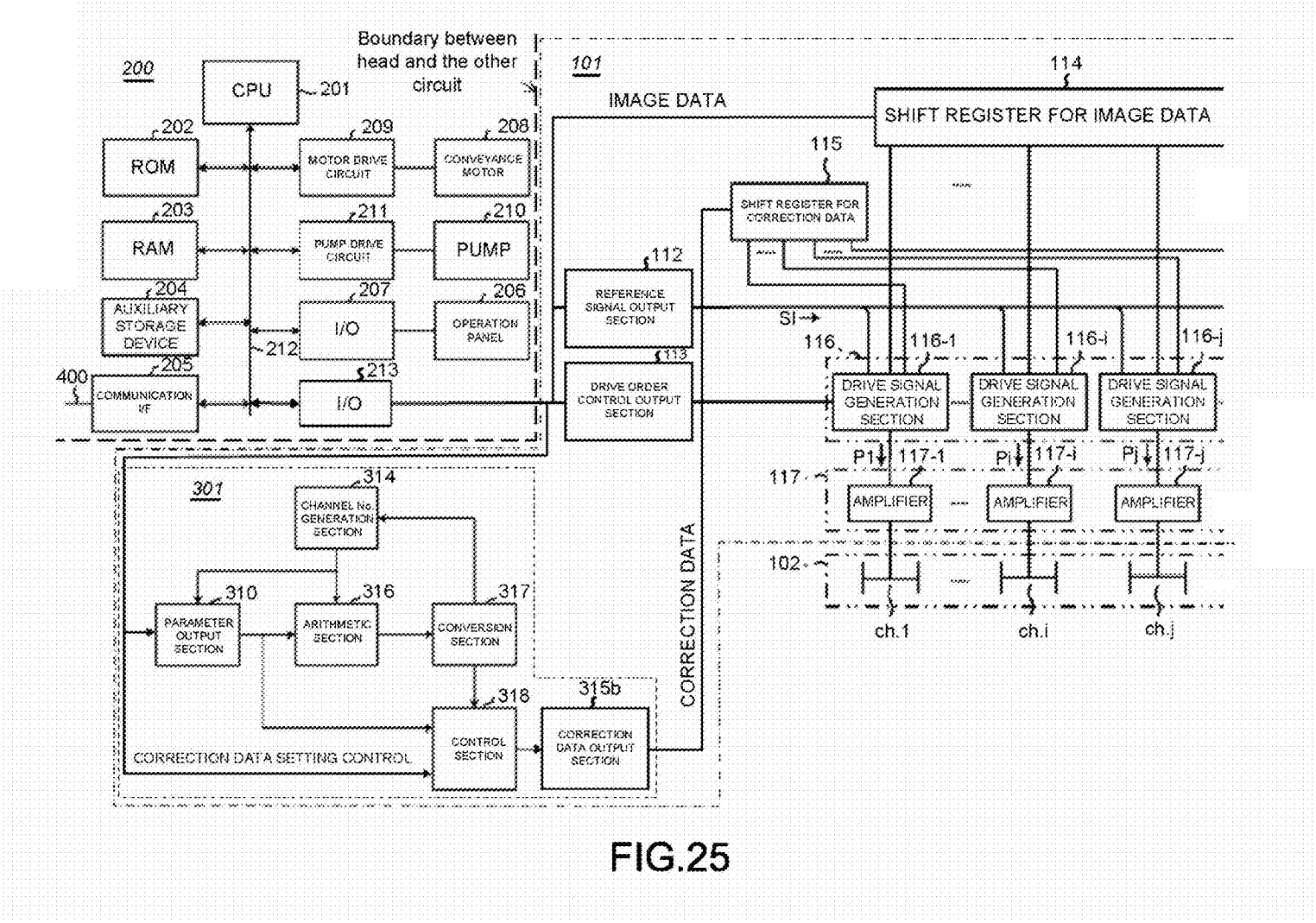
FIG. 25 is a block diagram illustrating a hardware constitution of an inkjet printer according to another embodiment.

FIG. 25 is another embodiment of a hardware constitution of an inkjet printer 200. In the embodiment, the correction data generating unit 301 is arranged in the head drive circuit 101. In the embodiment, the drive circuit 101 of the inkjet head 100 is controlled via the I/O port 213 connected with the bus line 212.

The output of the I/O port 213 becomes a boundary between the drive circuit 101 of the inkjet head 100 and another part in the printer 200. The image data is directly sent from the I/O port 213 to the shift register for image data 114. The reference signal output section 112 and the driving order control section 113 are controlled by the output of the I/O port 213. The parameter output section 310 is set by the output of the I/O port 213. The control section 318 receives the instruction from the output of the I/O port 213 to control generation of the correction data. In the embodiment, the CPU 201 of the printer 200 executes the control flow of the test print shown in FIG. 14 or FIG. 16. The test print may be executed by the printer 200 autonomously upon receiving the instruction from the operation panel 206 of the printer 200, or may be executed upon receiving the instruction from the information processing apparatus 300 via the communication line 400.

The correction data generated by the correction data generating unit 301 is sent to a shift register for correction data 115 via the correction data output section 315*b*.

Figure 26:
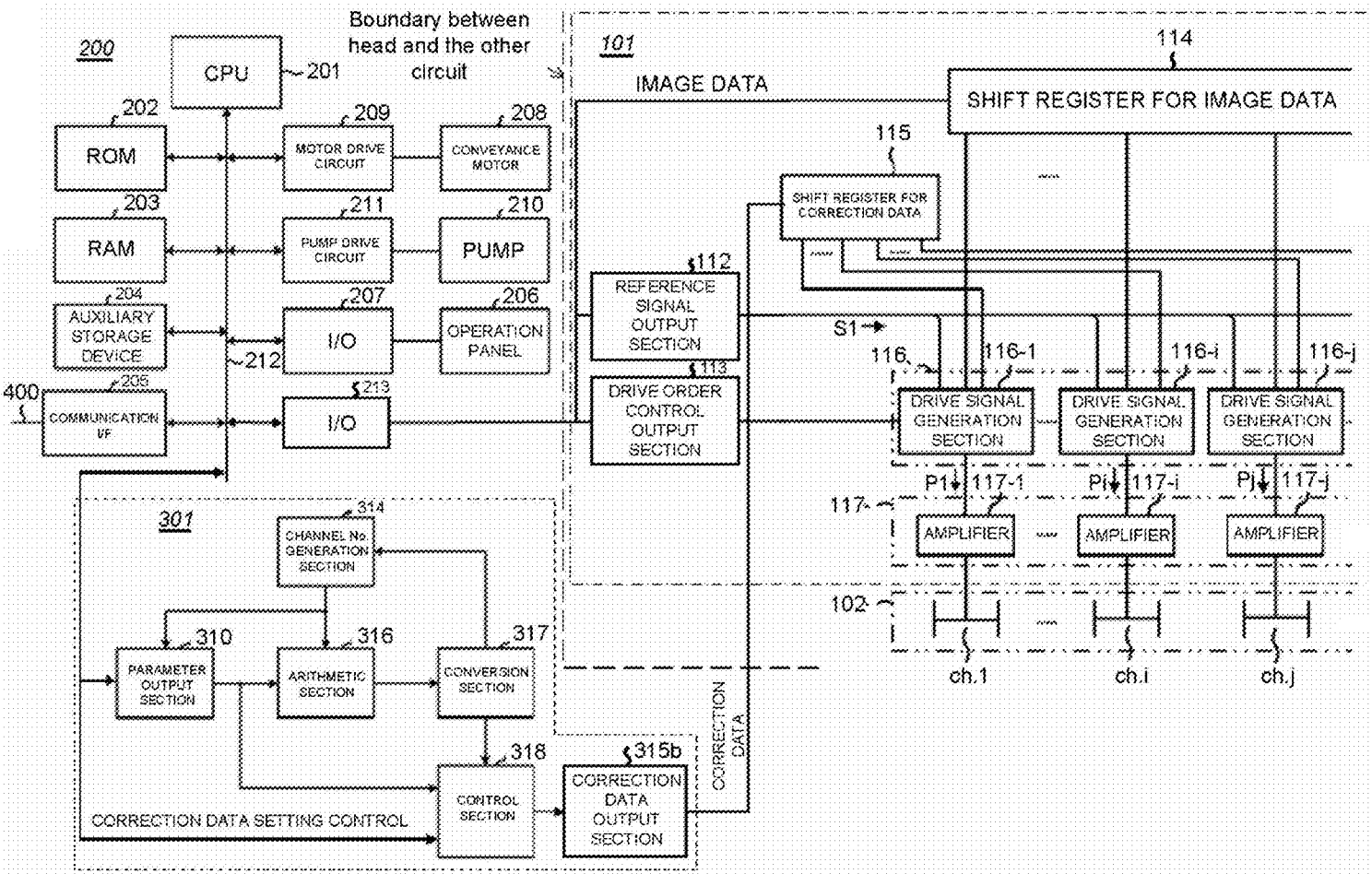
FIG. 26 is a block diagram illustrating a hardware constitution of an inkjet printer according to another embodiment.

FIG. 26 is another embodiment of a hardware constitution of an inkjet printer 200. In the embodiment, the correction data generating unit 301 is arranged outside the head drive circuit 101 and in the printer 200. In the embodiment, the parameter output section 310 and the control section 318 are controlled by the program of the CPU 201 connected with the bus line 212. Together with the output of the I/O port 213, a correction data line for connecting the correction data output section 315*b* and a shift register for correction data 115 becomes a boundary between the drive circuit 101 of the inkjet head 100 and another part in the printer 200.

Figure 27:
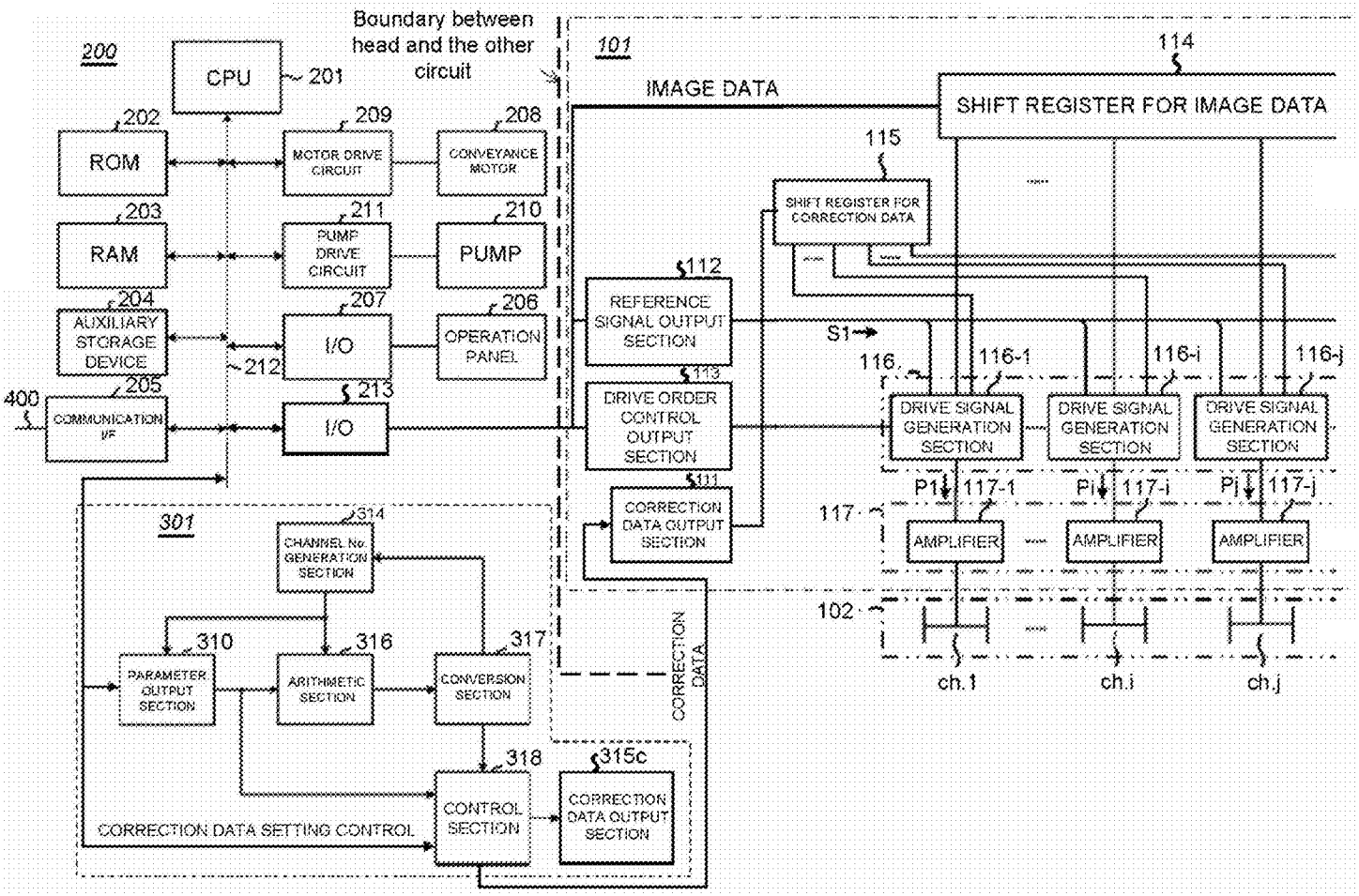
FIG. 27 is a block diagram illustrating a hardware constitution of an inkjet printer according to another embodiment.

FIG. 27 is another embodiment of a hardware constitution of an inkjet printer 200. The correction data generating unit 301 of the embodiment includes a memory 315*c* that temporarily stores the correction data. If a set of a plurality of correction data having different parameters is stored in the memory 315*c* in advance, overhead of processing time needed at the time of operations for changing the parameters in a plurality of areas to carry out a plurality of test prints can be reduced.

Figure 28:
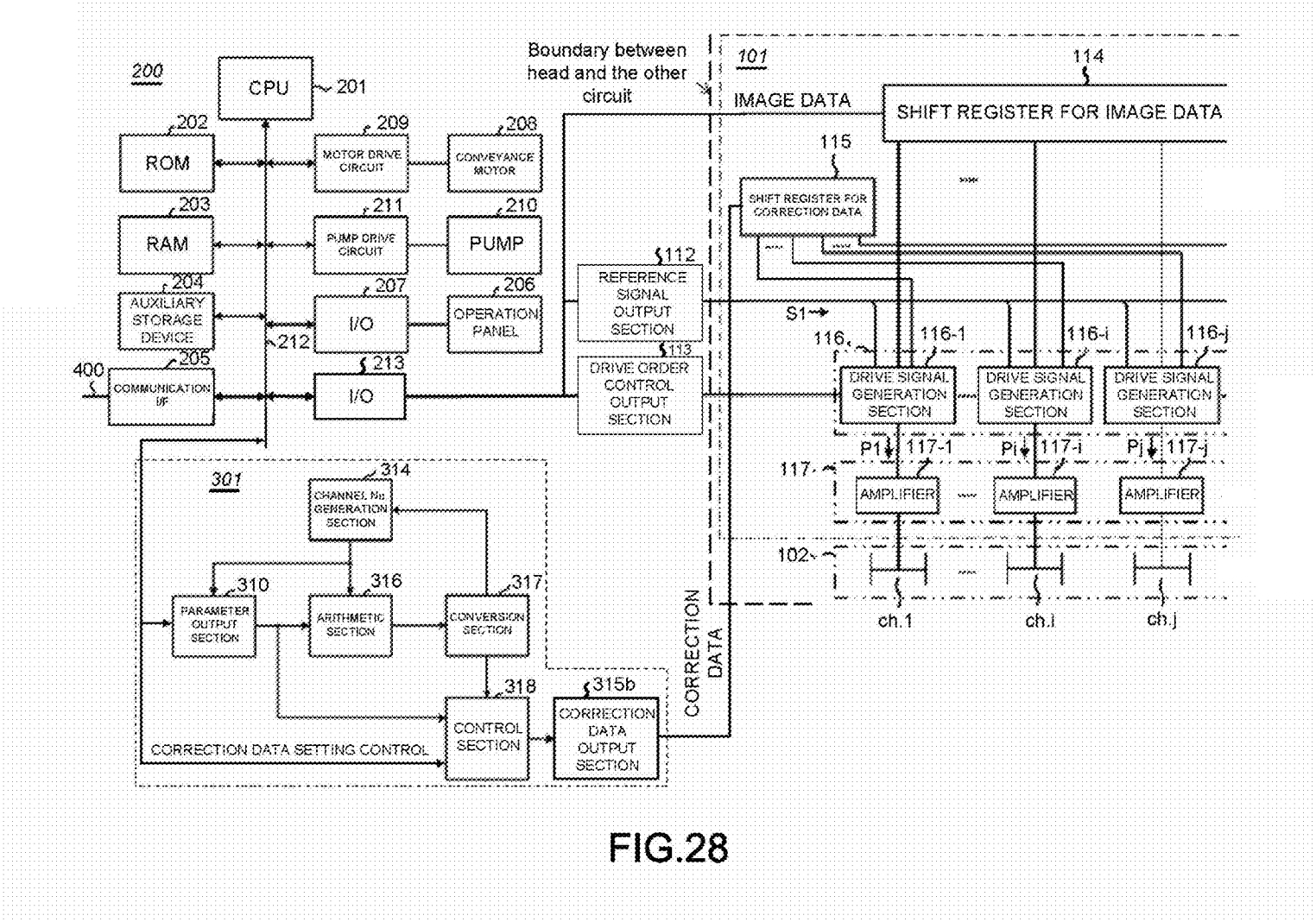
FIG. 28 is a block diagram illustrating a hardware constitution of an inkjet printer according to another embodiment.

FIG. 28 is another embodiment of a hardware constitution of an inkjet printer 200. In the embodiment, in the constitution in FIG. 26, in addition to the head drive circuit 101, the reference signal output section 112 and the driving order control section 113 are arranged in the printer 200 side.

The correction data generating unit 301 and each element thereof may be realized by hardware such as a processor and a memory and a dedicated application program, or may be realized by dedicated hardware. Further, part of each element may be realized by hardware, and other parts may be realized by a program.

The parameter output section 310 of the correction data generating unit 301 may be mainly constituted by an input device (a keyboard, a touch panel and the like) included in the information processing apparatus 300, and may be data stored in a nonvolatile memory.

The information processing apparatus 300 may include a function for applying the correction data to the printer 200 and a function for supplying the image data for printing to the printer 200, and the information processing apparatus 300 may only include the function for applying the correction data to the printer 200, and the image data for printing may be applied to the printer 200 by another means.

The correction data generating function 301 may be provided capable of being used by the user at any time, or may be a function provided capable of being used by only a service technician but not the user, or may be a function used in a manufacture process of a printer or a head.

The information processing apparatus 300 may be a jig capable of being used by the service technician, or may be a jig used in the manufacture process of the printer or the head.

Further, the technique of the test print is not limited to that described in the embodiment. For example, in the case of the line printer, if the width in the nozzle arrangement direction of the head 100 is smaller than a print width, a plurality of the heads 100 is arranged along the nozzle arrangement direction. Then, firstly, a solid image corresponding to each parameter is printed to select fine correction data for each head 100. Next, the solid images are printed with all heads using the selected correction data. As a result, if there is the density difference between the heads, the solid image corresponding to each parameter is printed again with the heads again to select the most suitable correction data with which the density difference is not generated.

Further, in the embodiment, the printer using the share mode-type head 100 is exemplified; however, it is needless to say that the correction data generating unit 301 of the present invention can also be applied to a printer using a type of head 100 which does not share an actuator with adjacent channels.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A correction data generating apparatus for generating correction data for correcting a drive pulse signal applied to each actuator respectively corresponding to one of a plurality of nozzles of an inkjet head, comprising:

a generation section configured to generate a channel number for individually identifying each nozzle;

a parameter output section configured to output a parameter required for arithmetic which represents a characteristic of a correction amount with respect to an arrangement direction of the nozzles, wherein the correction amount corresponds to correcting print density;

an arithmetic section configured to carry out the arithmetic using the parameter output from the parameter output section to calculate the correction amount for each channel number;

a conversion section configured to convert the correction amount calculated for each channel number by the arithmetic section to the correction data; and a correction data output section configured to output the correction data obtained for each channel number by the conversion section, wherein the conversion selection is configured to convert the correction amount for the each channel number to correction time for correcting a pulse width of the drive pulse signal for each channel.

2. The correction data generating apparatus according to claim 1, wherein the parameter output section outputs a plurality of values as parameters, further comprising:

a memory for storing the correction data and a selection section configured to select any one from the plurality of the values output as the parameters, wherein the correction data output section sets correction data obtained from the correction amount calculated using the parameter of the value selected by the selection section in the memory.

3. The correction data generating apparatus according to claim 1, wherein the arithmetic section calculates the correction amount by arithmetic which represents a characteristic that the correction amount is changed in a linear shape with respect to the arrangement direction of the nozzles.

4. The correction data generating apparatus according to claim 1, wherein the arithmetic section calculates the correction amount by arithmetic which represents a characteristic that the correction amount is changed in a spline shape with respect to the arrangement direction of the nozzles.

5. The correction data generating apparatus according to claim 1, wherein the arithmetic section calculates the correction amount by periodic function arithmetic which represents a characteristic that the correction amount is changed periodically and by a window function for setting a finite section of the characteristic with respect to the arrangement direction of the nozzles.

6. A method for generating correction data for correcting a drive pulse signal applied to each actuator respectively corresponding to one of a plurality of nozzles of an inkjet head, comprising the steps of:

generating a channel number for individually identifying each nozzle;

outputting a parameter required for arithmetic which represents a characteristic of a correction amount with respect to an arrangement direction of the nozzles;

carrying out the arithmetic using the parameter output from a parameter output section to calculate the correction amount for each channel number;

converting the correction amount calculated for each channel number by a arithmetic section to the correction data; and outputting the correction data obtained for each channel number by a conversion section characterized by further comprising converting the correction amount for the each channel number to correction time (t[nsec]) for correcting a pulse width of the drive pulse signal for each channel.

7. The method according to claim 6, further comprising the steps of:

outputting, by a parameter output section, a plurality of values as parameters;

providing a memory for storing the correction data and selecting, by a selection section, any one from the plurality of the values output as the parameters, wherein the correction data outputting step sets correction data obtained from the correction amount calculated using the parameter of the value selected by the selection section in the memory.

8. The method according to claim 6, further comprising the step of:

calculating the correction amount by arithmetic which represents a characteristic that the correction amount is changed in a linear shape with respect to the arrangement direction of the nozzles.

* * * * *